US006856889B2

(12) United States Patent
Nagaishi et al.

(10) Patent No.: US 6,856,889 B2
(45) Date of Patent: Feb. 15, 2005

(54) ENGINE FUEL INJECTION CONTROL

(75) Inventors: Hatsuo Nagaishi, Yokohama (JP); Takahiro Yoshino, Yokosuka (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/774,380

(22) Filed: Feb. 10, 2004

(65) Prior Publication Data

US 2004/0181331 A1 Sep. 16, 2004

(30) Foreign Application Priority Data

Mar. 11, 2003 (JP) ..... 2003-064747
Mar. 11, 2003 (JP) ..... 2003-064760
Mar. 11, 2003 (JP) ..... 2003-064776

(51) Int. Cl.[7] ..... F02D 41/06
(52) U.S. Cl. ..... 701/104; 123/480; 123/491; 123/435; 60/285
(58) Field of Search ..... 701/104; 123/480, 123/491, 494, 435; 60/285

(56) References Cited

U.S. PATENT DOCUMENTS 4,903,668 A * 2/1990 Ohata ..... 123/478
5,080,071 A * 1/1992 Minamitani et al. ..... 123/478
5,404,856 A * 4/1995 Servati ..... 123/478
5,529,043 A 6/1996 Nagaishi et al.
5,584,277 A * 12/1996 Chen et al. ..... 123/480
5,690,087 A * 11/1997 Schumacher et al. ..... 123/675
6,067,965 A * 5/2000 Trumpy et al. ..... 123/480
6,695,895 B2 * 2/2004 Hyodo et al. ..... 123/519

FOREIGN PATENT DOCUMENTS

JP 9-177580 A 7/1997
JP 9-303173 A 11/1997

* cited by examiner

*Primary Examiner*—Carl S. Miller
*Assistant Examiner*—Arnold Castro
(74) *Attorney, Agent, or Firm*—Foley & Lardner LLP

(57) ABSTRACT

A wall surface of a combustion chamber (5) of an internal combustion engine (1) is divided into a low temperature wall surface (5*b*) and a high temperature wall surface (5*a*, 6*a*, 15*a*) comprising other components, and behavior models of the fuel adhering to these wall surfaces are created. By determining the fuel ratio which vaporizes from the wall surfaces and burns, and the fuel ratio which is discharged without being burnt, in respective models according to the wall surface temperatures, particularly under transient conditions, these behavior models allow the fuel amount burnt in the combustion chamber (5) and the fuel amount discharged in the exhaust gas to be precisely known.

18 Claims, 11 Drawing Sheets

32 AIR FLOW METER
33 CRANK ANGLE SENSOR
34 CAM SENSOR
42 ACCELERATOR PEDAL DEPERESSION SENSOR
43 CATALYST TEMPERATURE SENSOR
44 INTAKE AIR TEMPERATURE SENSOR
45 WATER TEMPERATURE SENSOR
46 PRESSURE SENSOR
47 AIR/FUEL RATIO SENSOR
48 EXHAUST GAS TEMPERATURE SENSOR

ENGINE FUEL INJECTION CONTROL

FIELD OF THE INVENTION

This invention relates to fuel injection control of an internal combustion engine.

BACKGROUND OF THE INVENTION

Tokkai Hei No. 9-303173 published by the Japan Patent Office in 1998 relating to fuel injection control of an internal combustion engine, discloses a method of calculating a fuel injection amount using a wall flow model.

Wall flow means flow of fuel formed when some of the fuel injected from the fuel injector adheres to the wall surface of a combustion chamber or an intake port as well as to the valve body of an intake valve. Some of the wall flow vaporizes and burns, and some vaporizes after combustion is complete and is discharged from an exhaust valve without being burnt. The remaining part of the wall flow remains in the combustion chamber until the following combustion cycle.

The ratio of injected fuel which forms a wall flow is called the adhesion ratio. Of the fuel forming the wall flow, the ratio of fuel remaining in the combustion chamber in the wall flow state without vaporizing is referred to as the residual ratio.

In the prior art, a fuel behavior model of injected fuel is constructed having adhesion ratio and residual ratio as parameters, and by varying the parameters according to intake air pressure, it is attempted to comprehend the behavior of the fuel supplied to the internal combustion engine, and to improve the precision of fuel supply control.

SUMMARY OF THE INVENTION

The combustion chamber of the internal combustion engine is formed not only by the cylinder wall surface, but also by various components such as an intake valve, exhaust valve, cylinder head, piston crown and spark plug.

The fuel injected by the fuel injector adheres to each of these components, and forms a wall flow.

In the wall flow, the fuel ratio which vaporizes and burns depends on the adhesion surface temperature and the gas flow rate flowing over the adhesion surface. The higher the adhesion surface temperature is, the larger the vaporizing fuel amount is. Also, if the gas flow rate flowing over the adhesion surface is large, fuel adhering to the adhesion surface will be stripped off and a mist of fine particles will be formed. This mist of fine particles is burnt together with vaporized fuel due to the ignition of the spark plug without again forming a wall flow.

When the internal combustion engine starts operation at low temperature, the temperature of the members forming the combustion chamber is uniform. However, as the engine warms up, a temperature difference is produced between the members. The cylinders in the cylinder block are cooled by cooling water in a surrounding water jacket, so the temperature of the cylinder wall surface is substantially identical to that of the cooling water. On the other hand, members other than the cylinder wall surface are not cooled so much as the cylinder wall surface, so the temperature of these members rises considerably due to the heat of combustion. In particular, an intake valve and exhaust valve are in contact with a cylinder head only via a valve seat, so these valves are not easily cooled by the cooling water of the cylinder head, and parts of the valves facing the combustion chamber reach a temperature as high as 300 degrees Centigrade. As a result, there is a large difference in the vaporization characteristics of the wall flow depending on the member.

Regarding the difference of vaporization characteristics depending on the members forming the combustion chamber, in the prior art, the behavior of the wall flow of the wall surfaces of the combustion chamber is expressed by a simple model, so errors easily occur in defining the behavior of injected fuel during warm-up or in the transient state of the engine.

It is therefore an object of this invention to improve the precision of analysis of the behavior of injected fuel in an internal combustion engine.

In order to achieve the above object, this invention provides a fuel supply control device for such an internal combustion engine that comprises a combustion chamber formed from a low temperature wall surface and a high temperature wall surface, and a fuel supply mechanism which supplies volatile liquid fuel to the combustion chamber. The device comprises a sensor which detects a temperature of the low temperature wall surface, a sensor which detects a temperature of the high temperature wall surface, and a programmable controller.

The programmable controller is programmed to calculate respectively a fuel amount adhering to the low temperature wall surface, a fuel amount adhering to the high temperature wall surface, and a first vaporized fuel amount that is supplied in the form of gas or mist of fine particles in the combustion chamber relative to a fuel amount supplied by the fuel supply mechanism, calculate a second vaporized fuel amount which vaporizes from the fuel adhering to the low temperature wall surface and burns, according to the temperature of the low temperature wall surface, calculate a third vaporized fuel amount which vaporizes from the fuel adhering to the high temperature wall surface and burns, according to the temperature of the high temperature wall surface, calculate a combustion fuel amount in the combustion chamber based on the first vaporized fuel amount, the second vaporized fuel amount, and the third vaporized fuel amount, calculate a target fuel injection amount based on the combustion fuel amount, and control a fuel amount to be supplied by the fuel supply mechanism according to the target fuel injection amount.

This invention also provides a fuel supply control method for the internal combustion engine.

The method comprises determining a temperature of the low temperature wall surface, determining a temperature of the high temperature wall surface, calculating respectively a fuel amount adhering to the low temperature wall surface, a fuel amount adhering to the high temperature wall surface, and a first vaporized fuel amount that is supplied in the form of gas or mist of fine particles in the combustion chamber relative to a fuel amount supplied by the fuel supply mechanism, calculating a second vaporized fuel amount which vaporizes from the fuel adhering to the low temperature wall surface and burns, according to the temperature of the low temperature wall surface, calculating a third vaporized fuel amount which vaporizes from the fuel adhering to the high temperature wall surface and burns, according to the temperature of the high temperature wall surface, calculating a combustion fuel amount in the combustion chamber based on the first vaporized fuel amount, the second vaporized fuel amount, and the third vaporized fuel amount, calculating a target fuel injection amount based on the combustion fuel amount, and controlling a fuel amount to be supplied by the fuel supply mechanism according to the target fuel injection amount.

The details as well as other features and advantages of this invention are set forth in the remainder of the specification and are shown in the accompanying drawings.

DESCRIPTION OF THE PREFERRED EMBODIMENTS

Figure 1:
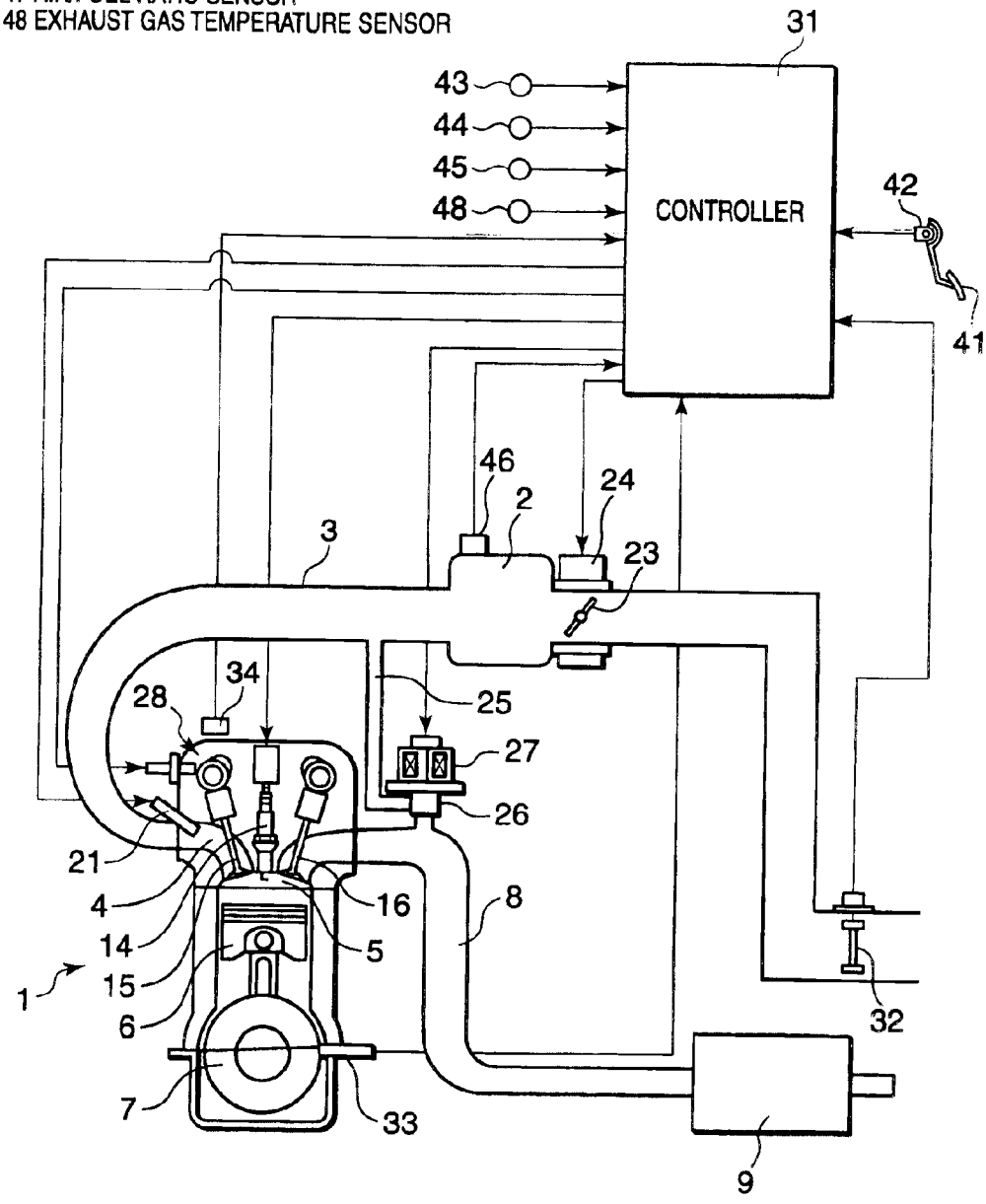
FIG. 1 is a schematic diagram of an internal combustion engine for an automobile to which this invention is applied.

Referring to FIG. 1 of the drawings, a four stroke-cycle internal combustion engine 1 is a multi-cylinder engine for an automobile provided with an L-jetronic type fuel injection device. The engine 1 compresses a gaseous mixture aspirated from an intake passage 3 to a combustion chamber 5 by a piston 6, and ignites the compressed gaseous mixture by a spark plug 14 to burn the gaseous mixture. The pressure of the combustion gas depresses the piston 6 so that a crankshaft 7 connected to the piston 6 rotates. The combustion gas is pushed out from the combustion chamber 5 by the piston 6 which was lifted due to the rotation of the crankshaft 7, and is discharged via an exhaust passage 8.

The piston 6 is housed in a cylinder 50 formed in a cylinder block. In the cylinder block, a water jacket through which a coolant flows is formed surrounding the cylinder 50.

An intake throttle 23 which adjusts the intake air amount and a collector 2 which distributes the intake air among the cylinders, are provided in the intake passage 3. The intake throttle 23 is driven by a throttle motor 24. Intake air distributed by the collector 2 is aspirated into the combustion chamber 5 of each cylinder via an intake valve 15 from an intake port 4. The intake valve 15 functions under a Valve Timing Control (VTC) mechanism 28 which varies the opening/closing timing. However, the variation of the valve opening/closing timing due to the VTC mechanism 28 is such a small variation that it does not affect the setting of a distribution ratio Xn described later.

Combustion gas in the combustion chamber 5 is discharged as exhaust gas to an exhaust passage 8 via an exhaust valve 16. The exhaust passage 8 is provided with a three-way catalytic converter 9. The three-way catalytic converter 9, by reducing nitrogen oxides (NOx) in the exhaust gas and oxidizing hydrocarbons (HC) and carbon monoxide (CO), removes toxic components in the exhaust gas. The three-way catalytic converter 9 has a desirable performance when the exhaust gas composition corresponds to the stoichiometric air-fuel ratio.

A fuel injector 21 which injects gasoline fuel into the intake air is installed in the intake port 4 of each cylinder.

A part of the exhaust gas discharged by the exhaust passage 8 is recirculated to the intake passage 3 via an exhaust gas recirculation (EGR) passage 25. The recirculation amount of the EGR passage 25 is adjusted by an exhaust gas recirculation (EGR) valve 26 driven by a diaphragm actuator 27.

The ignition timing of the spark plug 14, fuel injection amount and fuel injection timing of the fuel injector 21, change of valve timing by the VIC mechanism 28, operation of the throttle motor 24 which drives the intake throttle 23, and operation of the diaphragm actuator 27 which adjusts the opening of the EGR valve 26 are controlled by signals output by an engine controller 31 to the respective instruments.

The engine controller 31 comprises a microcomputer comprising a central processing unit (CPU), read-only memory (ROM), random access memory (RAM) and input/output interface (I/O interface). The engine controller 31 may also comprise plural microcomputers.

To perform the above control, detection results are input as signals to the controller 31 from various sensors which detect the running state of the engine 1.

These sensors include an air flow meter 32 which detects an intake air flow rate of the intake passage 3 upstream of the intake throttle 23, a crank angle sensor 33 which detects a crank angle and a rotation speed of the engine 1, a cam sensor 34 which detects a rotation position of a cam which drives the intake valve 15, an accelerator pedal depression sensor 42 which detects a depression amount of an accelerator pedal 41 with which the automobile is provided, a catalyst temperature sensor 43 which detects a catalyst temperature of the three-way catalytic converter 9, an intake air temperature sensor 44 which detects a temperature of the intake air of the intake passage 3, a water temperature sensor 45 which detects a cooling water temperature Tw of the engine 1, a pressure sensor 46 which detects an intake air pressure in the collector 2, an air-fuel ratio sensor 47 which detects an air-fuel ratio of the air/fuel mixture burnt in the combustion chamber from the exhaust gas composition flowing into the three-way catalytic converter 9, and an exhaust gas temperature sensor 48 which detects an exhaust gas temperature.

The engine controller 31 performs the aforesaid control in order to achieve the required engine output torque specified by the accelerator pedal depression amount, and achieve the exhaust gas composition required by the exhaust gas purification function of the three-way catalytic converter 9, as well as to reduce the fuel consumption.

Specifically, the engine controller 31 determines a target torque of the internal combustion engine 1 according to the accelerator pedal depression amount, determines a target intake air amount required to achieve the target output torque, and adjusts the opening of an intake throttle 23 via the throttle motor 24 so that the target intake air amount is achieved.

On the other hand, the engine controller 31 feedback controls the fuel injection amount of the fuel injector 21 so that the air-fuel ratio of the gaseous mixture burnt in the combustion chamber 5 is maintained within a predetermined range centered on the stoichiometric air-fuel ratio, based on the air-fuel ratio in the combustion chamber 5 detected from the exhaust gas composition by the air-fuel ratio sensor 47. The controller 31 also adjusts an EGR flow rate via the EGR valve 26 and reduces the fuel consumption by adjusting the valve timing of the VTC mechanism 28.

The controller 31 applies combustion prediction control to the control of the fuel injection amount. This control predicts the wall flow and unburnt fuel in the intake port 4 and combustion chamber 5 with temperature as the main parameter, and calculates the fuel injection amount using the result.

Figure 2:
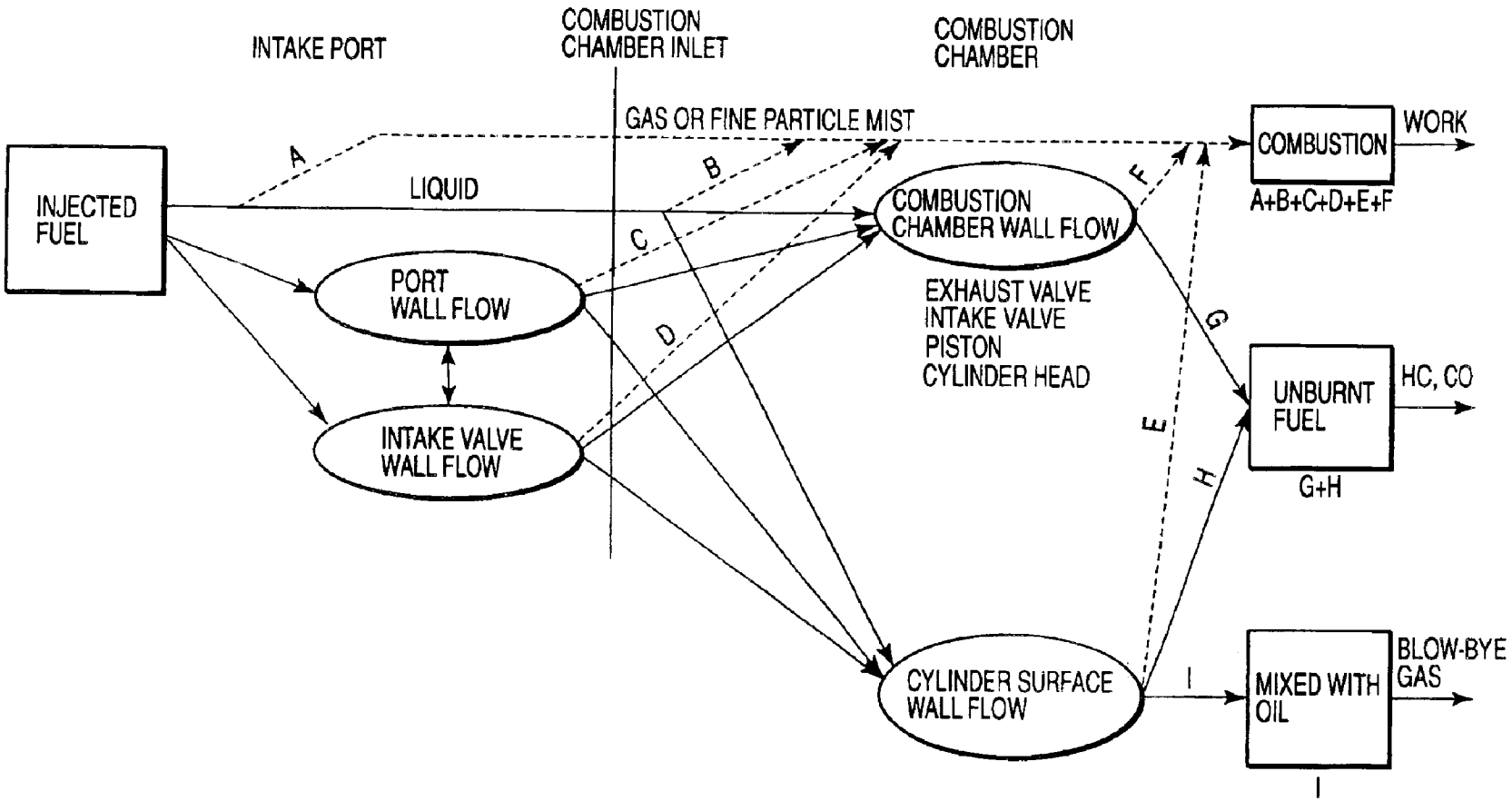
FIG. 2 is a schematic diagram of a fuel behavior model according to this invention.
Figure 3:
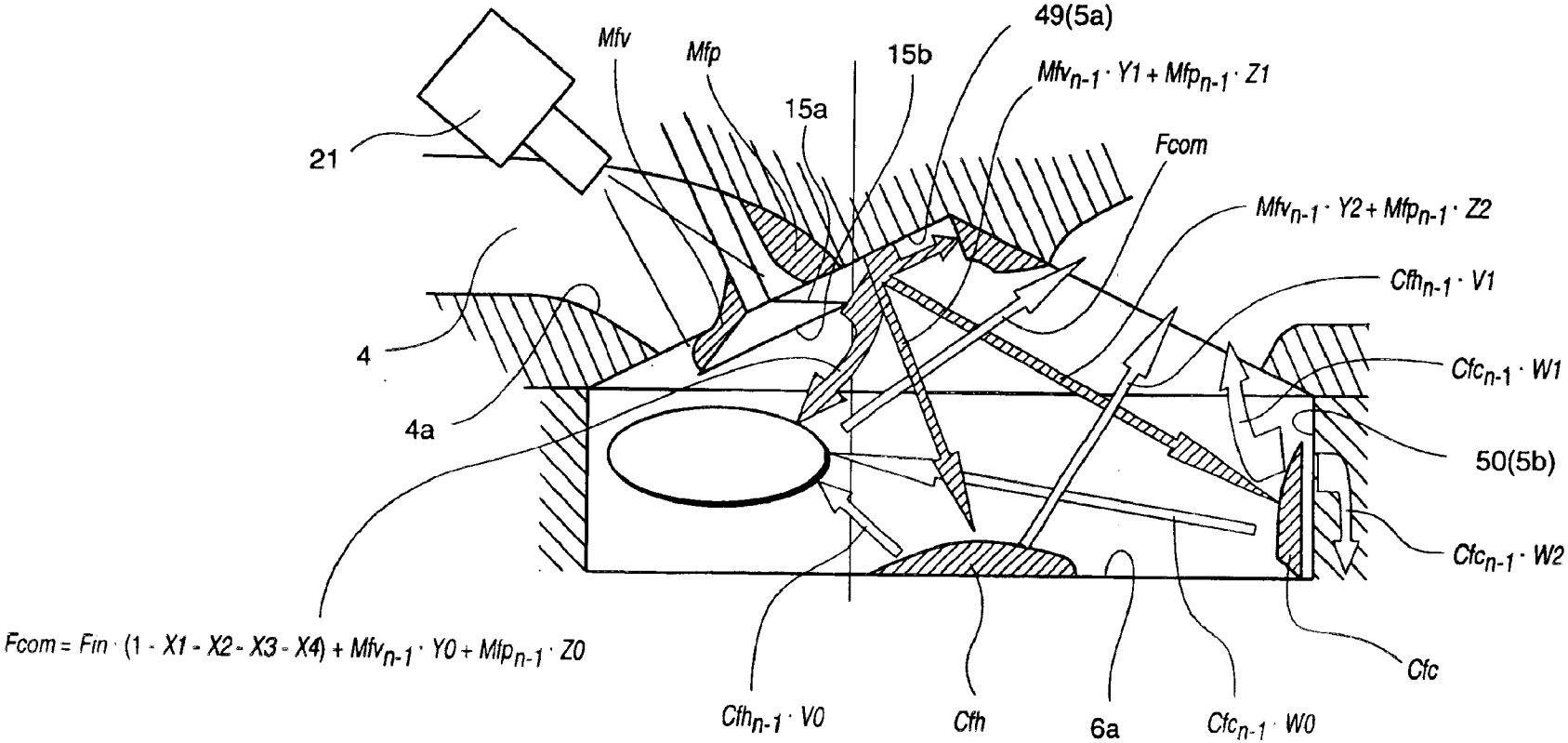
FIG. 3 is a block diagram describing the behavior of injected fuel.

Referring to FIGS. 2 and 3, part of the fuel injected by the fuel injector 21 flows directly into the combustion chamber 5 as a vapor or a mist of fine particles, as shown by the dotted line. Part also flows into the combustion chamber 5 directly or as a wall flow, in the liquid state or as a mist of coarse particles. The mist of fine particles is strictly speaking also liquid, but here it is distinguished from a mist of coarse particles due to its behavior characteristics regardless of whether it is a vapor or a liquid. In other words, the mist of fine particles is treated identically to a vapor which does not adhere to the wall surface of the intake port 4 up to the inlet of the combustion chamber 5, and a behavior inside the combustion chamber 5.

Behavior Up to Inlet of Combustion Chamber 5

Part of the fuel injected by the fuel injector 21 flows directly into the combustion chamber 5. The remaining fuel, as shown in FIG. 3, adheres to a wall surface 4*a* of the intake port 4 and the intake valve 15. The fuel adhering to the intake valve 15 may be classified as fuel adhering to a part 15*a* facing the intake port 4 of the valve body, and fuel adhering to a part 15*b* facing the combustion chamber 5. Here, we shall deal with the former, and deal with the latter in the section describing the behavior inside the combustion chamber 5.

For the purpose of this description, fuel adhering to the wall surface 4*a* is referred to as port wall flow, and fuel adhering to the part 15*a* of the intake valve 15 is referred to as valve wall flow.

Part of the port wall flow and part of the valve wall flow respectively detach from the adhesion surface due to evaporation. Alternatively, they separate from the adhesion surface due to the intake air flow or gravity, and become a fine particle mist. This detachment ratio depends on the temperature of the wall surface 4*a* and part 15*a*. The temperatures of the wall surface 4*a* and part 15*a* are identical immediately after startup, but as warm-up proceeds, the temperature of the part 15*a* largely exceeds the temperature of the wall surface 4*a*. Therefore, the detachment ratio of fuel adhering to the wall surface 4*a* and the detachment ratio of fuel adhering to the part 15*a* show different variations depending on the progress of warm-up.

On the other hand, in the port wall flow and valve wall flow, fuel which has not detached from the adhesion surface moves over the adhesion surface as wall flow to enter the combustion chamber 5.

Behavior Inside Combustion Chamber 5

Of the fuel which has reached the combustion chamber (5) by various routes, most is burnt, but some adheres to the wall surface of the combustion chamber 5. The adhesion locations include a part 15*b* of the intake valve 15, the surface of the exhaust valve 16 adjacent to the combustion chamber 5, a wall surface 5*a* of the cylinder head forming the upper end of the combustion chamber 5, a crown 6*a* of the piston 6, a protrusion part of the spark plug 14, and a cylinder wall surface 5*b*.

Part of the wall flow in the combustion chamber 5 vaporizes due to compression heat and the wall surface heat so as to become a gas or a mist of fine particles before the ignition timing, and detaches from the adhesion surface. Part becomes a gas or a mist of fine particles after combustion of the fuel is complete, and is discharged from the exhaust valve 16 to the exhaust passage 8 without being burnt. Further, part of the fuel adhering to the cylinder wall surface 5*b* is diluted by lubricating oil of the engine 1 depending on the stroke of the piston 6, and flows out to a crankcase below the piston 6.

In the following description, the fuel adhesion surface of the combustion chamber 5 is separated into the cylinder wall surface 5*b* and other parts. The separation of the fuel adhesion surface of the combustion chamber 5 into these two parts is because the temperature difference between the two parts is large. As the cylinder wall surface 5*b* is cooled by the cooling water of the water jacket formed in the cylinder block, it maintains a temperature effectively identical to the cooling water temperature Tw.

On the other hand, as regards the other parts, the part 15*b* of the intake valve 15 reaches the highest temperature, and the surface of the exhaust valve 16 facing the combustion chamber 1, and the crown 6*a* of the piston 6 follow. The temperature of the cylinder head wall surface 5*a* is lower than these temperatures, but higher than that of the cylinder wall surface 5*b*.

Due to these reasons, in the following description, among the fuel adhesion surfaces of the combustion chamber 5, the cylinder wall surface 5*b* will be referred to as a combustion chamber low temperature wall surface, and the other adhesion surfaces will be referred to as a combustion chamber high temperature wall surface. The fuel adhesion surfaces of the combustion chamber 5 can also be separated into three or more wall surfaces depending on temperature conditions.

Based on the above analysis, the wall flow formed inside the combustion chamber 5 can be separated into a wall flow formed on the combustion chamber low temperature wall surface, and a wall flow formed on the combustion chamber high temperature wall surface. On the other hand, the fuel in the combustion chamber 5 can be separated into fuel which contributes to combustion, fuel discharged as unburnt fuel, and fuel diluted by engine lubricating oil which flows out to the crankcase.

Referring to FIG. 2, the fuel which contributes to combustion becomes gas or a mist of fine particles present in the combustion chamber 5, and comprises the following components A–F:

A: Gas or a mist of fine particles produced immediately after fuel injection by the fuel injector 21, B: Fuel which flows into the combustion chamber 5 as a mist of coarse particles, and becomes gas or a mist of fine particles in the combustion chamber 5, C: Gas or a mist of fine particles produced from part of the port wall flow, D: Gas or a mist of fine particles produced from part of the valve wall flow, E: Gas or a mist of fine particles produced from part of the wall flow on the combustion chamber low temperature wall surface, and F: Gas or mist of fine particles produced from part of the wall flow on the combustion chamber high temperature wall surface.

The fuel discharged as unburnt fuel is also gas or a mist of fine particles present in the combustion chamber 5, and comprises the following components G and H:

G: Gas or a mist of fine particles produced from part of the wall flow on the combustion chamber high temperature wall surface after combustion is complete, and H: Gas or a mist of fine particles produced from part of the wall flow on the combustion chamber low temperature wall surface after combustion is complete.

The fuel flowing out to the crankcase comprises the following component I:

I: Fuel comprising part of the wall flow of the combustion chamber low temperature wall surface, which is diluted by engine lubricating oil.

Therefore, the wall flow formed by the fuel injection of the fuel injector 21 comprises four adhesion fuels, i.e., intake port adhesion fuel, intake valve adhesion fuel, combustion chamber low temperature wall surface adhesion fuel and combustion chamber high temperature wall surface adhesion fuel. The combustion prediction control applied by the controller 31 to control of the fuel injection amount, is based on an air-fuel mixture model per cylinder designed according to this classification.

Figure 4:
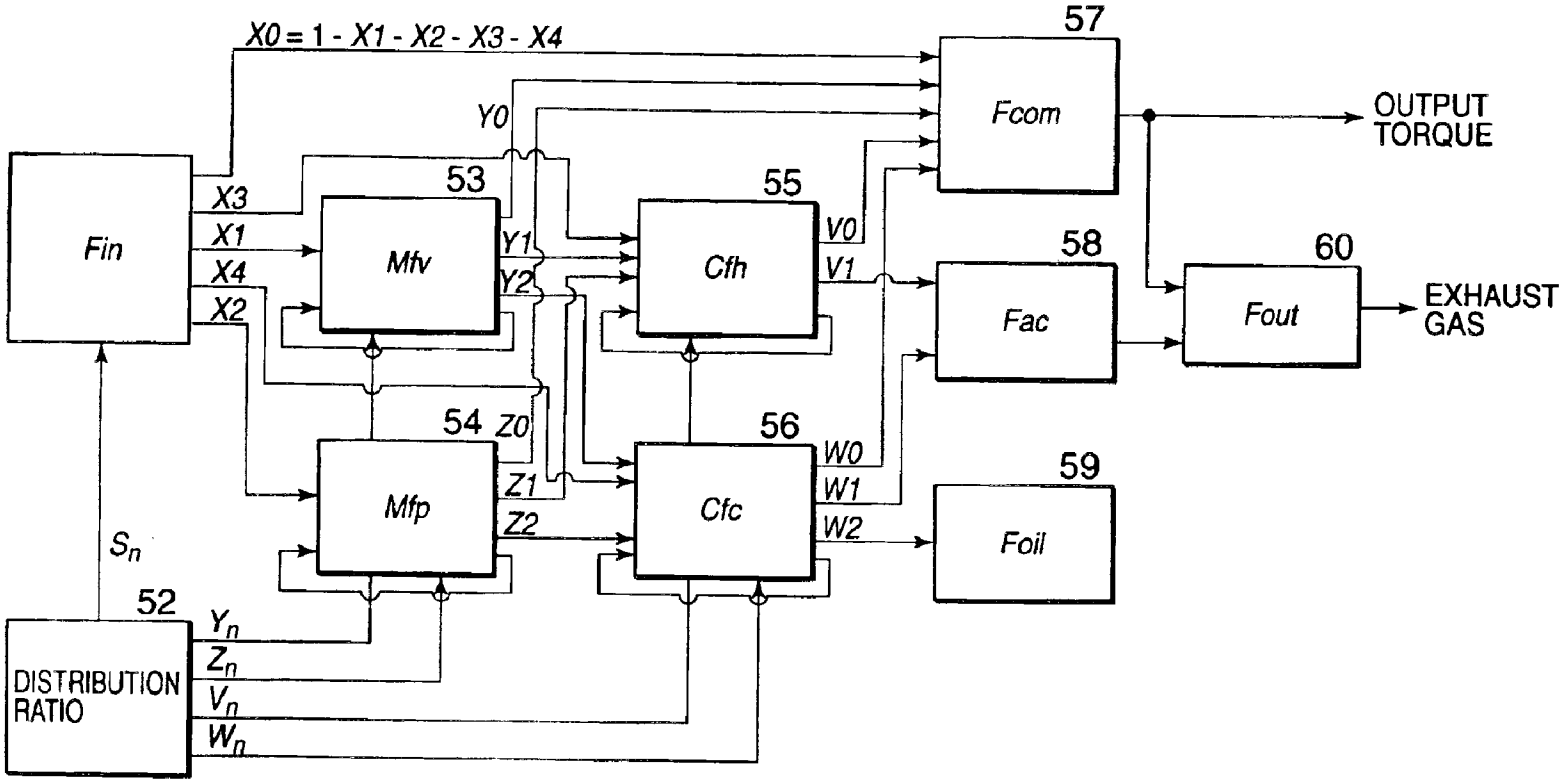
FIG. 4 is a block diagram describing a fuel behavior analysis function of an engine controller according to this invention.

Referring to FIG. 4, to perform the fuel behavior analysis based on this air-fuel mixture model, the controller 31 comprises a fuel distribution ratio calculating unit 52, intake valve adhesion amount calculating unit 53, intake port adhesion amount calculating unit 54, combustion chamber high temperature wall surface adhesion amount calculating unit 55, combustion chamber low temperature wall surface adhesion amount calculating unit 56, combustion fraction calculating unit 57, unburnt fraction calculating unit 58, crankcase outflow fraction calculating unit 59, and discharged fuel calculating unit 60. The controller 31 performs a fuel behavior analysis by these units 52–60 each time the fuel injector 21 injects fuel.

These units 52–60 show the functions of the controller 31 as virtual units, and do not exist physically.

Summarizing the fuel behavior analysis functions, the controller 31 quantitatively analyzes the aforesaid components A–I relative to the fuel injection amount Fin injected by the fuel injector 21, and calculates a burnt fuel amount Fcom, fuel amount Fout corresponding to the exhaust gas composition, and fuel amount Foil flowing out to the crankcase. The burnt fuel amount Fcom corresponds to the components A–F. The fuel amount Fout corresponding to the exhaust gas composition is the sum of the components A–F and the components G and H which are the unburnt fuel amount. The fuel amount Foil flowing out to the crankcase corresponds to the component I.

Next, the functions of these units will be described.

The fuel distribution ratio calculating unit 52 determines how to progressively divide the fuel injection amount Fin between each part. The distribution ratio Xn shows the distribution ratio of the fuel injection amount Fin. The distribution ratio Yn shows the subsequent distribution ratio of fuel which has adhered to the intake valve 15. The distribution ratio Zn shows the subsequent distribution ratio of fuel which has adhered to the wall surface 4*a* of the intake port 4. The distribution ratio Vn shows the subsequent distribution ratio of fuel which has adhered to the combustion chamber high temperature wall surface. The distribution ratio Wn shows the subsequent distribution ratio of fuel which has adhered to the combustion chamber low temperature wall surface. The method of calculating the distribution ratios Xn, Yn, Zn, Vn, Wn will be described later.

Herein, the distribution ratios Xn, Yn, Zn, Vn, Wn will respectively be described as known values. The situation will be described assuming that the fuel injector 21 has just injected fuel. This injection amount will be taken as Fin. Therefore, the fuel injection amount Fin is a value known by the controller 31.

The intake valve adhesion amount calculating unit 53 calculates an intake valve adhesion amount Mfv by the following equation (1) from the fuel injection amount Fin and the distribution ratios Xn, Yn, Zn. Likewise, the intake port adhesion amount calculating unit 54 calculates an intake port adhesion amount Mfp by the following equation (2).

$$Mfv=Mfv_{n-1}+Fin\cdot X1-Mfv_{n-1}\cdot(Y0+Y1+Y2) \quad (1)$$

$$Mfp=Mfp_{n-1}+Fin\cdot X2-Mfp_{n-1}\cdot(Z0+Z1+Z2) \quad (2)$$

where, Mfv=intake valve adhesion amount, $Mfv_{n-1}$=value of Mfv in immediately preceding combustion cycle, Mfp=intake port adhesion amount, $Mfp_{n-1}$=value of Mfp in immediately preceding combustion cycle, Fin=fuel injection amount, X1=adhesion ratio of injected fuel to intake valve, X2=adhesion ratio of injected fuel to intake port, Y0=ratio of fuel relative to $Mfv_{n-1}$ which became gas or mist of fine particles and entered combustion chamber 5 prior to present injection, Y1=ratio of fuel relative to $Mfv_{n-1}$ which became combustion chamber low temperature wall flow prior to present injection, Y2=ratio of fuel relative to $Mfv_{n-1}$ which became combustion chamber high temperature wall flow prior to present injection, Z0=ratio of fuel relative to $Mfp_{n-1}$ which became gas or mist of fine particles and entered combustion chamber 5 prior to present injection, Z1=ratio of fuel relative to $Mfp_{n-1}$ which became combustion chamber low temperature wall flow prior to present injection, and Z2=ratio of fuel with respect to $Mfp_{n-1}$ which became combustion chamber high temperature wall flow prior to present injection.

In equation (1), an adhesion amount Fin·X1 due to the present fuel injection is first added to the intake valve adhesion amount $Mfv_{n-1}$ in the immediately preceding combustion cycle, and part of the intake valve adhesion amount $Mfv_{n-1}$ in the immediately preceding combustion cycle, i.e., a fuel amount $Mfv_{n-1}$·(Y0+Y1+Y2) which flowed into the combustion chamber 5 prior to the present fuel injection, is subtracted from the result.

In equation (2), an adhesion amount Fin·X2 due to the present fuel injection is first added to the intake port adhesion amount $Mfp_{n-1}$ in the immediately preceding combustion cycle, and part of the intake port adhesion amount $Mfp_{n-1}$ in the immediately preceding combustion cycle, i.e., a fuel amount $Mfp_{n-1}$·(Z0+Z1+Z2) which flowed into the combustion chamber 5 prior to the present fuel injection, is subtracted from the result.

The combustion chamber high temperature wall surface adhesion amount calculating unit 55 calculates a combustion chamber high temperature wall surface adhesion amount Cfh by the following equation (3) from the fuel injection amount Fin, the distribution ratios Xn, Yn, Vn, Wn, and the intake valve adhesion amount $Mfv_{n-1}$ and intake port adhesion amount $Mfp_{n-1}$ in the immediately preceding combustion cycle.

$$Cfh=Cfh_{n-1}+Fin\cdot X3+Mfv_{n-1}\cdot Y1+Mfp_{n-1}\cdot Z1-Cfh_{n-1}\cdot(V0+V1) \quad (3)$$

Likewise, the combustion chamber low temperature wall surface adhesion amount calculating unit 56 calculates a combustion chamber low temperature wall surface adhesion amount Cfc by the following equation (4):

$$Cfc=Cfc_{n-1}+Fin\cdot X4+Mfv_{n-1}\cdot Y2+Mfp_{n-1}\cdot Z2-Cfc_{n-1}\cdot(W0+W1+W2) \quad (4)$$

where, Cfh=combustion chamber high temperature wall surface adhesion amount, $Cfh_{n-1}$=value of Cfh in immediately preceding combustion cycle, Cfc=combustion chamber low temperature wall surface adhesion amount.

$Cfc_{n-1}$=value of Cfc in immediately preceding combustion cycle,

X3=adhesion ratio of injected fuel to combustion chamber low temperature wall surface, X4=adhesion ratio of injected fuel to combustion chamber high temperature wall surface, V0=ratio of fuel relative to $Cfh_{n-1}$ which burnt prior to present injection, V1=ratio of fuel relative to $Cfh_{n-1}$ which was discharged as unburnt fuel prior to present injection, W0=ratio of fuel relative to $Cfc_{n-1}$ which burnt prior to present injection, W1=ratio of fuel relative to $Cfc_{n-1}$ which was discharged as unburnt fuel prior to present injection, and W2=ratio of fuel relative to $Cfc_{n-1}$ which flowed out to crankcase prior to present injection.

In equation (3), a fuel amount Fin·X4 due to the present fuel injection is first added to the combustion chamber high temperature wall surface adhesion amount $Cfh_{n-1}$ in the immediately preceding combustion cycle, and part of the combustion chamber high temperature wall surface adhesion amount $Cfh_{n-1}$ in the immediately preceding combustion cycle, i.e., a fuel amount $Cfh_{n-1}$·(V0+V1) discharged to the outside prior to the present fuel injection, is subtracted from the result.

In equation (4), a fuel amount Fin·X3 due to the present fuel injection is first added to the combustion chamber low temperature wall surface adhesion amount $Cfc_{n-1}$ in the immediately preceding combustion cycle, and part of the combustion chamber low temperature wall surface adhesion amount $Cfc_{n-1}$ in the immediately preceding combustion cycle, i.e., a fuel amount $Cfc_{n-1}$·(W0+W1+W2) discharged to the outside prior to the present fuel injection, is subtracted from the result.

It should be noted that FIGS. 2–4 show the fuel behavior model for calculating the real fuel amount injected by the controller 31, but the fuel behavior model is the combination of separate fuel behavior models, i.e., an intake valve wall flow model expressed by equation (1), an intake port wall flow model expressed by equation (2), a combustion chamber high temperature wall surface wall flow model expressed by equation (3), and a combustion chamber low temperature wall surface wall flow model expressed by equation (4).

A combustion fraction calculating unit 57 calculates the burnt fuel amount Fcom by the following equation (5):

$$Fcom=Fin\cdot(1-X1-X2-X3-X4)+Mfv_{n-1}\cdot Y0+Mfp_{n-1}\cdot Z0+Cfh_{n-1}\cdot V0+Cfc_{n-1}\cdot W0 \quad (5)$$

The burnt fuel amount Fcom obtained by equation (5) corresponds to the sum value of the aforesaid components A–F. 1−X1−X2−X3−X4 in equation (5) corresponds to the ratio X0 of the component A.

The unburnt fraction calculating unit 58 calculates the fuel amount Fac discharged as unburnt fuel.

$$Fac=Cfh_{n-1}\cdot V1+Cfc_{n-1}\cdot W1 \quad (6)$$

The fuel amount Fac discharged as unburnt fuel obtained by equation (6) corresponds to the sum value of the aforesaid components G and H.

The crankcase outflow fraction calculating unit 59 calculates the fuel amount Foil flowing out to the crankcase by the following equation (7):

$$Foil=Cfc_{n-1}\cdot W2 \quad (7)$$

The fuel amount Foil flowing out of the crankcase obtained by equation (7) corresponds to the aforesaid component I.

The discharged fuel calculating unit 60 calculates the fuel amount Fout which forms an exhaust gas component by the following equation (8):

$$Fout=Fcom+Fac \quad (8)$$

The fuel amount Fout obtained by equation (8) is the sum of the burnt fuel amount Fcom and the fuel amount Fac discharged as unburnt fuel In other words, the fuel amount Fout is the sum total of the fuel flowing out to the exhaust passage 8. Part of the gas in the combustion chamber 5 remains in the combustion chamber 5 without being discharged, but considering that it cancels out the gas remaining in the preceding combustion cycle, the remaining fraction is not considered in equation (8).

The fuel amounts calculated in the aforesaid equations (1)–(8) are shown graphically in FIG. 3.

Figure 5:
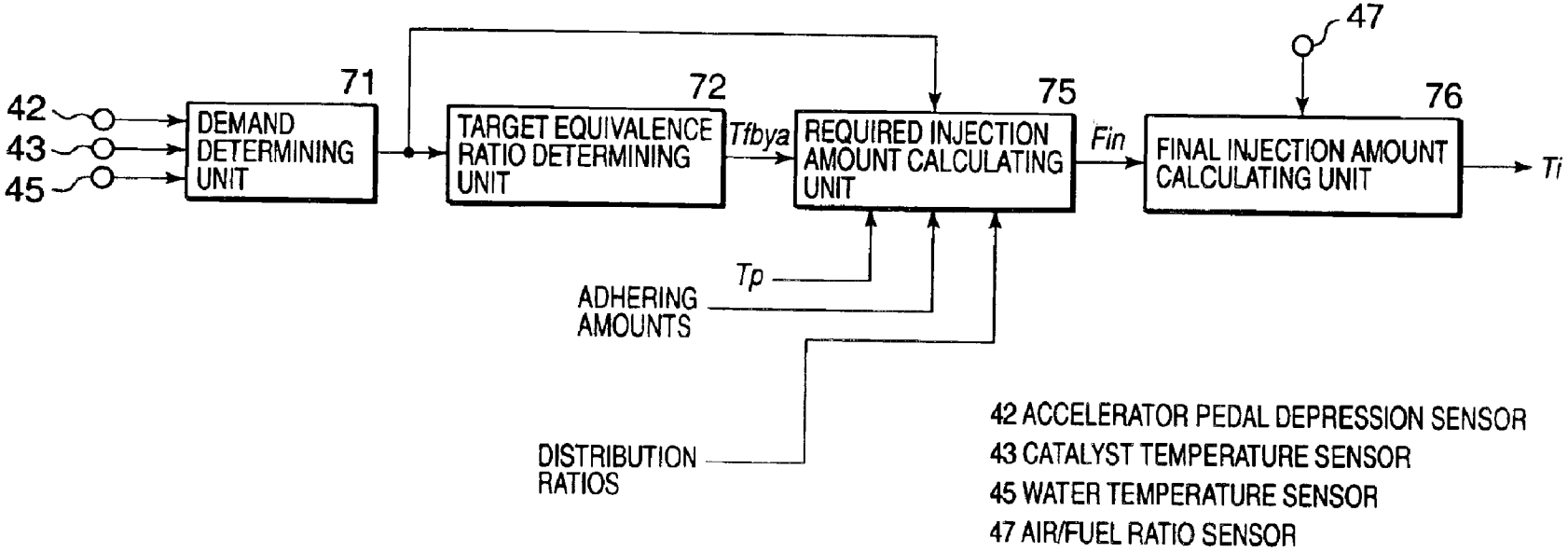
FIG. 5 is a block diagram describing a fuel injection amount calculation function of the engine controller.

The controller 31 feedback controls the fuel injected by the fuel injector 21 according to the construction shown in FIG. 5 using the aforesaid fuel behavior analysis results.

Referring to FIG. 5, in addition to the units 52–60 shown in FIG. 4, the controller 31 further comprises a demand determining unit 71, a target equivalence ratio determining unit 72, a required injection amount calculating unit 75 and final injection amount-calculating unit 76. These units 71, 72, 75, 76 represent the functions of the controller 31 as virtual units, and do not exist physically.

Referring to FIG. 5, concerning the equivalence ratio of the fuel-air mixture, the demand determining unit 71 determines whether or not there is a demand regarding exhaust gas composition, whether or not there is a demand regarding engine output power, and whether or not there is a demand regarding engine running stability.

The equivalence ratio is a value obtained by dividing the stoichiometric air-fuel ratio by the air-fuel ratio. The stoichiometric air-fuel ratio is 14.7, and when the air-fuel ratio is identical to the stoichiometric air-fuel ratio, the equivalence ratio is 1.0. When the equivalent ratio is more than 1.0, the air-fuel ratio is rich, and when the equivalence ratio is less than 1.0, the air-fuel ratio is lean.

A demand regarding exhaust gas composition is output when the three-way catalyst of the three-way catalytic converter 9 is activated. Specifically, it is output when the detection temperature of the catalyst temperature sensor 43 reaches the catalyst activation temperature. When the three-way catalyst is activated, the exhaust gas composition corresponding to the stoichiometric air-fuel ratio is required in order for the three-way catalyst to satisfy its functions of reducing nitrogen oxides and oxidizing carbon monoxide and hydrocarbons.

A demand regarding engine output power is output in order to increase the engine output power. Specifically, when the depression amount of the accelerator pedal 41 detected by the accelerator pedal depression sensor 42 exceeds a predetermined amount, it is determined that there is a demand for engine output power.

A demand regarding engine running stability is output when the engine 1 starts at low temperature, within a predetermined time from startup. Specifically, when the water temperature on engine startup detected by the water temperature sensor 45 is less than a predetermined temperature, a demand regarding engine running stability is output from startup of the engine 1 for a predetermined warm-up time period.

The demand determining unit 71 determines the aforesaid three demands. The measurement of the elapsed time from startup of the engine 1 is performed using the clock function of the microcomputer forming the controller 31.

The target equivalence ratio determining unit 72 determines the target equivalence ratio of the air-fuel mixture supplied to the combustion chamber 5 of the engine 1 according to the demand determined by the demand determining unit 71. Specifically, when there is a demand for engine output power or a demand for engine running stability, a target equivalence ratio Tfbya is set to a value from 1.1 to 1.2. When there is a demand for exhaust gas composition, the target equivalence ratio Tfbya is set to 1.0 corresponding to the stoichiometric air-fuel ratio A demand for engine output power or a demand for engine running stability has priority over a demand for exhaust gas composition. Also, when there are no demands, the target equivalence ratio Tfbya is set to 1.0 corresponding to the stoichiometric air-fuel ratio. In other words, as long as there is no demand for engine output power or demand for engine running stability, the target equivalence ratio determining unit 72 sets the target equivalent ratio Tfbya to 1.0.

The required injected fuel calculating unit 75 calculates the required injection amount Fin based on the target equivalence ratio Tfbya, the demand determined by the demand determining unit 71, the fuel distribution ratio set by the fuel distribution ratio calculating unit 52, and the adhesion amounts $Mfv_{n-1}$, $Mfp_{n-1}$, $Cfh_{n-1}$, $Cfc_{n-1}$ calculated by the adhesion amount calculating units 53–36 by the following process.

The fuel amount Fcom burnt in the combustion chamber 5 is given by the aforesaid equation (5). This can be rewritten as the following equation (9):

$$\begin{aligned} Fcom &= Fin \cdot X0 + Mfv_{n-1} \cdot Y0 + Mfp_{n-1} \cdot Z0 + Cfh_{n-1} \cdot \\ &\quad V0 + Cfc_{n-1} \cdot W0 \\ &= K\# \cdot Tfbya \cdot Tp \end{aligned} \tag{9}$$

where, K#=constant for unit conversion, $$Tp = \text{basic fuel injection amount} = \frac{Qs}{Ne} \cdot K,$$

Qs=intake air flow rate detected by the air flow meter 32,

Ne=engine rotation speed detected by the crank angle sensor 33, and

K=constant.

The calculation of the basic fuel injection amount Tp is known from U.S. Pat. No. 5,529,043.

The required injection amount calculating unit 75, when there is a demand for engine output power or a demand for engine running stability, sets the ratio of the burnt fuel amount Fcom and cylinder intake air amount Qcyl to be richer than the stoichiometric air-fuel ratio, i.e., sets the target equivalence ratio Tfbya in equation (9) to a predetermined value from 1.1 to 1.2, and calculates the required injection amount Fin by equation (10):

$$Fin = \frac{K\# \cdot Tfbya \cdot Tp - (Mfv_{n-1} \cdot Y0 + Mfp_{n-1} \cdot Z0 + Cfh_{n-1} \cdot V0 + Cfv_{n-1} \cdot W0)}{X0} \tag{10}$$

When there is no demand for engine output power or engine running stability, the required injection amount Fin is calculated by the following equation (11) with the target equivalent ratio Tfbya as 1.0.

$$\begin{aligned} Fin = \{&K\# \cdot Tfbya \cdot Tp - (Mfv_{n-1} \cdot Y0 + Mfp_{n-1} \cdot \\ &Z0 + Cfh_{n-1} \cdot V0 + Cfc_{n-1} \cdot W0 + \\ &Cfh_{n-1} \cdot V1 + Cfc_{n-1} \cdot W1)\} \cdot \frac{1}{X0} \end{aligned} \tag{11}$$

Equation (11) includes $Cfh_{n-1} \cdot V1 + Cfc_{n-1} \cdot W1$ which was not added in equation (10) in the calculation of the required injection amount Fin. This corresponds to the components G and H discharged from the exhaust valve 16 as unburnt fuel. In most cases when there is no demand for engine output power or engine running stability, there is a demand for exhaust gas composition. Here, it is not the air-fuel ratio of the burnt air-fuel mixture which directly affects the action of the three-way catalyst, but the exhaust gas composition. Therefore, in equation (11), the unburnt gas $Cfh_{n-1} \cdot V1 + Cfc_{n-1} \cdot W1$ is taken into account to determine the required injection amount Fin. On the other hand, the unburnt fuel gas does not contribute to combustion, and is not taken into account in equation (10).

The basic fuel injection amount Tp of equation (9) is a value expressing the fuel injection amount per cylinder in terms of mass. Also, all of Fin, $Mfv_{n-1}$, $Mfp_{n-1}$, $Cfh_{n-1}$ and $Cfc_{n-1}$ on the right-hand side of equation (9) are masses per cylinder. The fuel injection signal which the controller 31 outputs to the fuel injector 21 is a pulse width modulation signal, and its units are not milligrams which are mass units but milliseconds which show pulse width. If Fin, $Mfv_{n-1}$, $Mfp_{n-1}$, $Cfh_{n-1}$ and $Cfc_{n-1}$ on the right-hand side of equation (9) are expressed in milliseconds, the constant K# is 1.0.

The final injection amount calculating unit 76 calculates a final injection amount Ti using the following equation (12a) or (12b) based on the required injection amount Fin calculated by the required injection amount calculating unit 75. Here, the units of Fin and Ti are also milliseconds.

$$Ti=Fin\cdot\alpha\cdot\alpha m\cdot 2+Ts \quad (12a)$$

$$Ti=Fin\cdot(\alpha+\alpha m-1)+Ts \quad (12b)$$

where, $\alpha$=air-fuel ratio feedback correction coefficient, $\alpha m$=air-fuel ratio learning correction coefficient, and Ts=ineffectual pulse width.

Here, the air-fuel ratio feedback correction coefficient $\alpha$ is set by having the controller 31 compare the air-fuel ratio corresponding to the target equivalence ratio Tfbya with the real air-fuel ratio detected by the air-fuel ratio sensor 47, and performing proportional/integral control according to the difference. The change of air-fuel ratio feedback correction coefficient $\alpha$ is also learned, and the air-fuel ratio learning correction coefficient am is determined. The control of air-fuel ratio by such feedback and learning is known from U.S. Pat. No. 5,529,043.

The controller 31 outputs a pulse width modulation signal equivalent to the final injection amount Ti to the fuel injector 31.

The required injection amount Fin calculated by the required injection amount calculating unit 75 is used in the following combustion cycle as the fuel injection amount Fin of the fuel behavior analysis shown in FIG. 4. In this way, control of the fuel injection amount of the fuel injector 21 is performed for every combustion cycle.

Calculation of the final injection amount Ti in the above process is much different from the conventional calculation of Ti for L-jetronic type fuel injection device that is represented, for example, by the following equations (13) and (14). The equations (13) and (14) are disclosed in Tokkai Hei No. 9-177580 published by the Japan Patent Office.

$$Ti=(Tp+Kathos)\cdot TFBYA\cdot(\alpha+KBLRC-1)+Ts \quad (13)$$

$$TFBYA=KAS+KTW+KUB+KMR+KHOT \quad (14)$$

where, TFBYA=target equivalence ratio,

Kathos=wall flow correction amount, $\alpha$=air-fuel ratio feedback correction coefficient, KBLRC=air-fuel ratio learning correction coefficient, KAS==increase correction coefficient during and after start-up, KTW=water temperature increase correction coefficient, KUB=increase correction coefficient for unburnt fuel, KMR=increase correction coefficient for high load and high rotation speed, KHOT=increase correction coefficient for high water temperature, and Ts=ineffectual pulse width.

As can be understood from the equations (13) and (14), the conventional calculation applies various increase coefficients KTW, KAS, KUB, KMR, KHOT and Kathos to respectively compensate for various operation conditions. However, applying many coefficients require many experiments and simulations to determine their values. Further, in the conventional calculation method, fuel behavior analysis is not performed in the determination of the coefficients KTW, KAS and KUB.

According to this invention, the behavior of injected fuel is first analyzed as shown in FIGS. 2 and 3, and the fuel injection amount is calculated using the fuel behavior models obtained by the analysis. In the calculation, the coefficients KTW, KAS, KUB, KMR and KHOT are not required. Further, instead of the wall flow correction amount Kathos of the conventional method, this invention applies four kinds of adhesion amounts Mfv, Mfp, Cfh and Cfc.

According to this invention, therefore, the precision of fuel injection control in the transient state of the engine is increased while simplifying the calculation process.

Next, the method of calculating the distribution ratios Xn, Yn, Zn, Vn, Wn performed by the fuel distribution ratio calculating unit 52 will be described in each case.

Distribution Ratios Xn of Required Injection Amount Fin

X0: The fuel ratio of the fuel injected by the fuel injector 21 which flows directly into the combustion chamber 5 as gas or a mist of fine particles, and burnt. According to a simulation by the inventors, the ratio X0 is a small value of several percent except for the case where any of the intake stroke injection, assist air supply, stratified combustion or swirl formation by a swirl control valve is performed. The parameters which affect the ratio X0 include the injection timing of the fuel injector 21, particle size of the mist, fuel volatility, temperature around the fuel injector 21 and the relative flow rate. The relative flow rate means the flow rate of gas aspirated by the engine 1 relative to the injected fuel flow rate, and is affected by the engine rotation speed, the valve timing of the intake valve 15 and the flow path diameter of the intake port 4. If the ratio X0 increases, the other ratios X1–X4 will decrease.

The distribution ratio X0 corresponds to the ratio of the first vaporized fuel amount in the claims.

X1: The fuel ratio of the fuel injected by the fuel injector 21 which adheres to the part 15*a* of the intake valve 15. The fuel injector 21 faces the part 15*a*, so the larger portion of injected fuel first adheres to the part 15*a*. Therefore, it is the largest among X0–X4.

A part rebounds and adheres to the wall surface 4*a* of the intake port 4. A parameter which affects the ratio X1 is the intake valve direct adhesion rate of injected fuel, and the ratio X1 is larger, the higher is the intake valve direct adhesion rate. The intake valve direct adhesion rate can be geometrically calculated according to the design of the intake port 4, the intake valve 15 and the fuel injector 21.

X2: The fuel ratio of the fuel injected by the fuel injector 21 which adheres to the wall surface 4*a* of the intake port 4. This includes a part which strikes the part 15*a* of the intake valve 15 and rebounds, and a part which is carried away from the part 15*a* by the reverse intake air flow due to the opening of the intake valve 15, and adheres to the wall surface 4*a* of the intake port 4. In the case where assist air is supplied, the ratio X2 increases as the divergence angle of the fuel spray due to the assist air becomes larger. The ratio X2 increases as fuel spray moves upstream from the intake port 4 due to the assist air. Unlike X1, the ratio X2 decreases as the intake valve strike rate of injected fuel becomes larger.

X3: The fuel ratio of the fuel injected by the fuel injector 21 which passes through the intake valve 15, and directly adheres to the high temperature wall surface of the combustion chamber 5. Except for the case where intake stroke injection and assist air supply are performed, X3 is very small. This is because fuel does not directly reach the combustion chamber 5 while the intake valve 15 is closed. The parameters affecting the ratio X3 are the particle size of the fuel spray, fuel injection timing, injection direction and injection position.

The distribution ratio X3 corresponds to the ratio of the second wall flow amount in the claims.

X4: The fuel ratio of the fuel injected by the fuel injector 21 which passes through the intake valve 15 and directly adheres to the low temperature wall surface of the combustion chamber 5. If fuel injection is performed when the intake valve 15 is open due to an intake stroke injection, the ratio X4 increases. The increase of X4 leads to instability of combustion, increased amounts of hydrocarbons and increase of blow-by gas. When the fuel spray from the fuel injector 21 is finely atomized, the ratio of X4 is small. The parameters which affect the ratio X4 are the same as the parameters which affect the ratio X3.

The distribution ratio X4 corresponds to the ratio of the first wall flow amount in the claims.

Figure 6:
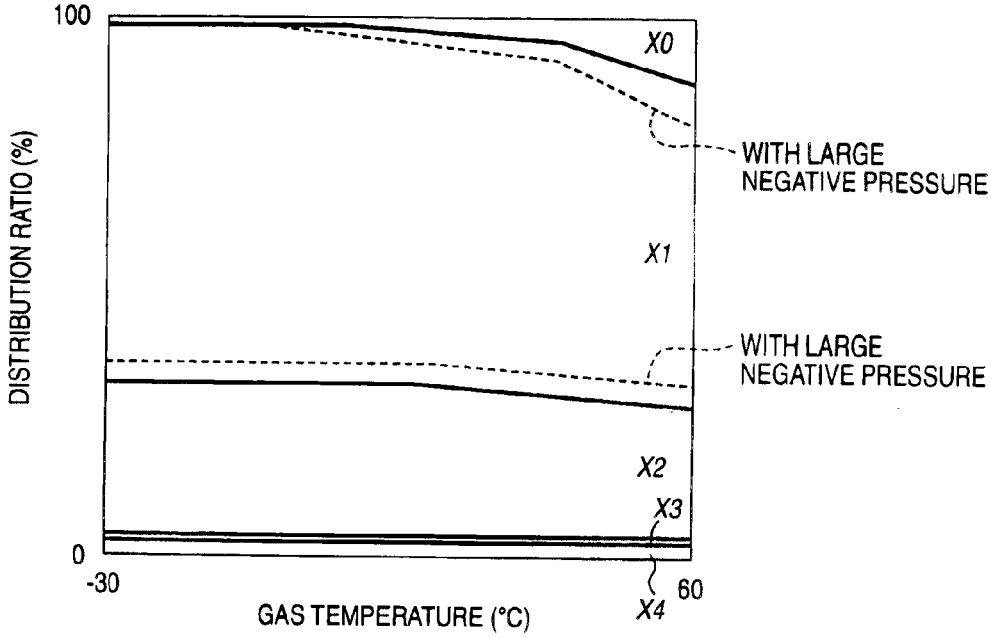
FIG. 6 is a diagram showing the relation between a temperature of intake air surrounding a fuel injector, an intake air pressure and a fuel distribution ratio experimentally verified by the Inventors.
Figure 7:
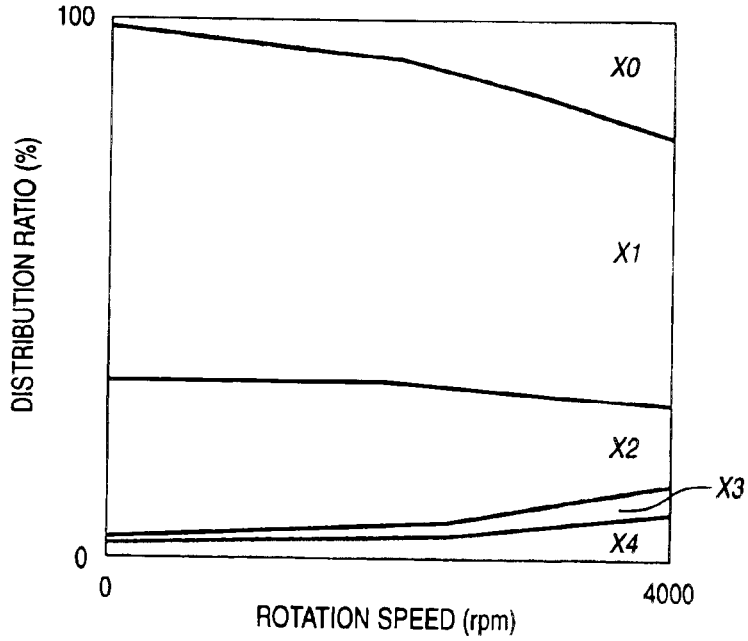
FIG. 7 is a diagram showing a relation between an intake air flow rate and the fuel distribution ratio experimentally verified by the Inventors.
Figure 8:
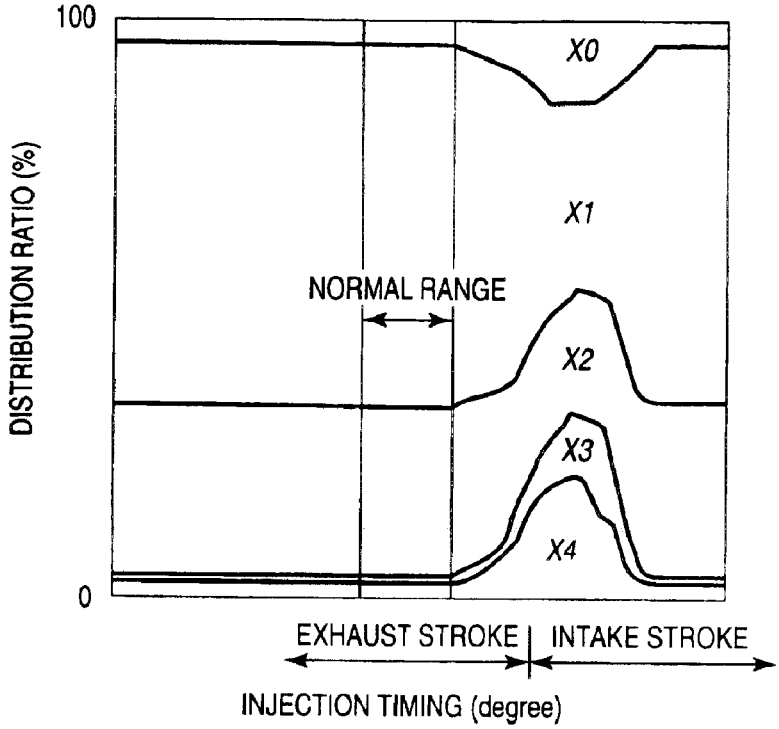
FIG. 8 is a diagram showing the relation between a fuel injection timing and the fuel distribution ratio experimentally verified by the Inventors.

Referring to FIGS. 6–8, the results of an analysis by the inventors of the fuel injector of a multi-point injection (MPI) system, wherein fuel is injected towards the valve body of the intake valve, will now be described. The engine is assumed to have one or two intake valves per cylinder. It is also assumed that if two intake valves are provided, the fuel injector has two injection nozzles facing each valve. The widths in the vertical direction of each region of FIGS. 6–8 express the distribution ratios Xn.

Referring to FIG. 6, vaporization of injected fuel is promoted more and the fuel ratio X0 which flows directly into combustion chamber 5 and is burnt, becomes larger, the higher is the temperature of the gas around the fuel injector 21. As shown by the dotted line of the drawing, the region of the distribution ratio X0 becomes larger also when the intake negative pressure of the engine 1 is large.

On the other hand, as the injected fuel diffuses if the intake negative pressure of the engine 1 is large, the distribution ratio X2 of fuel adhering to the wall surface 4*a* of the intake port 4 increases.

Referring to FIG. 7, as the flow rate of gas of the intake port 4 will increase if the engine rotation speed rises, the inflow rate of injected fuel to the combustion chamber 5 increases. In other words, the distribution ratios X0, X3 and X4 increase.

Referring to FIG. 8, by performing a fuel injection in the intake stroke as compared with the standard fuel injection in the exhaust stroke, the distribution ratios X0, X3 and X4 increase. This is because fuel injection is performed in a state where air is aspirated by the combustion chamber 5 from the open intake valve 15, so injected fuel is easily aspirated into the combustion chamber 5 together with intake air. Due to overlap of the opening periods of the intake valve 15 and exhaust valve 16, hot combustion gas remaining in the combustion chamber 5 may flow backwards to the intake port 4 as the intake valve 15 opens.

If a fuel injection is performed in the immediately following intake stroke, due to the high temperature and kinetic energy of the combustion gas which flowed backwards, vaporization of fuel will be promoted and the distribution ratio X0 will increase as a result.

Referring to the characteristics shown in FIGS. 6–8, the value of the distribution ratio Xn is determined according to the temperature of the surrounding gas of the fuel injector 21, the load of the engine 1 and the rotation speed of the engine 1. The characteristics of FIGS. 6–8 apply to an engine provided with an intake throttle in the intake passage, and not having a VTC mechanism in the intake valve. However, a VTC mechanism in which the valve timing variation is small, is within tolerance level as in the case of the VTC mechanism 28.

For example, an engine which does not have an intake throttle but adjusts intake air volume by a special intake valve, an engine provided with a solenoid type intake valve and an engine with a variable compression ratio are not considered here.

The temperature of the gas around the fuel injector of FIG. 6 is the ambient temperature of the air and residual gas surrounding the mist of fuel injected by the fuel injector 21, and is estimated by the detection temperature of the intake air temperature sensor 44 or the water temperature sensor 45.

The characteristics of the distribution ratios X0–X4 shown in FIGS. 6–8 are obtained only through calculations, so when they actually applied, the values of these distribution ratios should be adapted according to engine specifications. For example, the effect of the fuel injection timing of the fuel injector 21 can be disregarded when the injection timing does not vary much. In this case, a correction by the following equation (15) is performed based on the flow rate and intake negative pressure of gas to determine the distribution ratios X0–X4.

$$X0=X0P\cdot X0N \tag{15}$$

where, X0P=basic distribution ratio (%) according to temperature and pressure, and X0N=rotation speed correction coefficient (absolute number).

Figure 13:
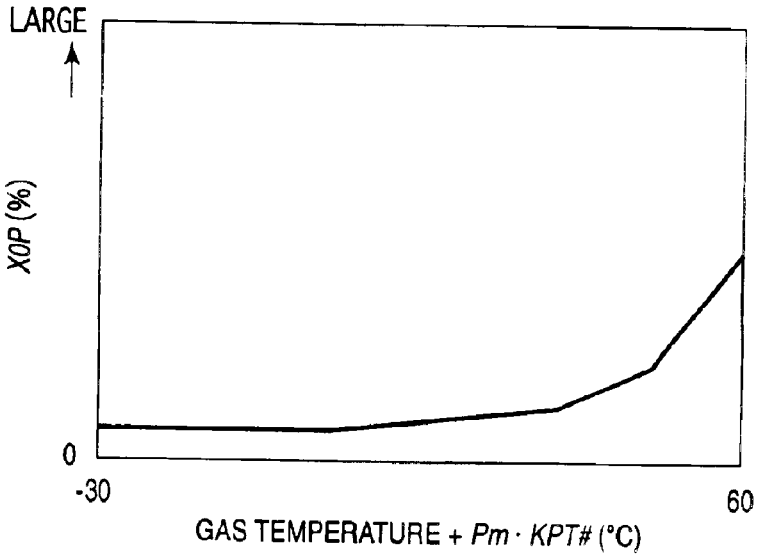
FIG. 13 is a diagram describing the characteristics of a basic distribution ratio map stored by the engine controller.

The fuel distribution ratio calculating unit 52 calculates the basic distribution ratio X0P by looking up a characteristic map shown in FIG. 13 from the temperature and intake negative pressure of the gas around the fuel injector. This map corresponds to the characteristics of the distribution ratio X0 shown in FIG. 6. This map is stored beforehand in the memory (ROM) of the controller 31. The detection temperature of the intake air temperature sensor 44 is used as the temperature, and the detection pressure of the pressure sensor 46 is used as the intake negative pressure, of the gas around the fuel injector.

In FIG. 13, Pm expresses the intake negative pressure. KPT# is a coefficient for converting volatilization pressure into temperature. As shown in the drawing, the basic distribution ratio (%) increases, the higher the temperature is, and the larger the value of the intake negative pressure Pm is, of the gas around the fuel injector. The intake negative pressure Pm becomes large when the load of the engine 1 is small. Instead of the intake negative pressure Pm, the basic fuel injection amount Tp may be used as a value expressing the load of the engine 1.

Figure 14:
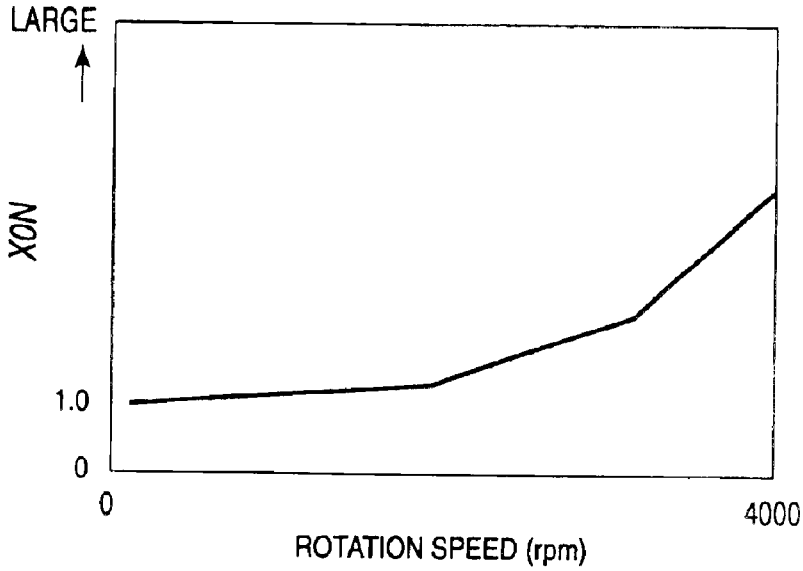
FIG. 14 is a diagram describing the characteristics of a rotation speed correction coefficient map stored by the engine controller.

The rotation speed correction coefficient X0N is calculated by looking up a map having the characteristics shown in FIG. 14 from the engine rotation speed Ne detected by the crank angle sensor 33. This map corresponds to the characteristics of the distribution ratio X0 of FIG. 7, and is set so that the rotation speed correction coefficient X0N takes a larger value as the engine rotation speed Ne increases. This map is stored beforehand in the memory (ROM) of the controller 31.

Figure 15:
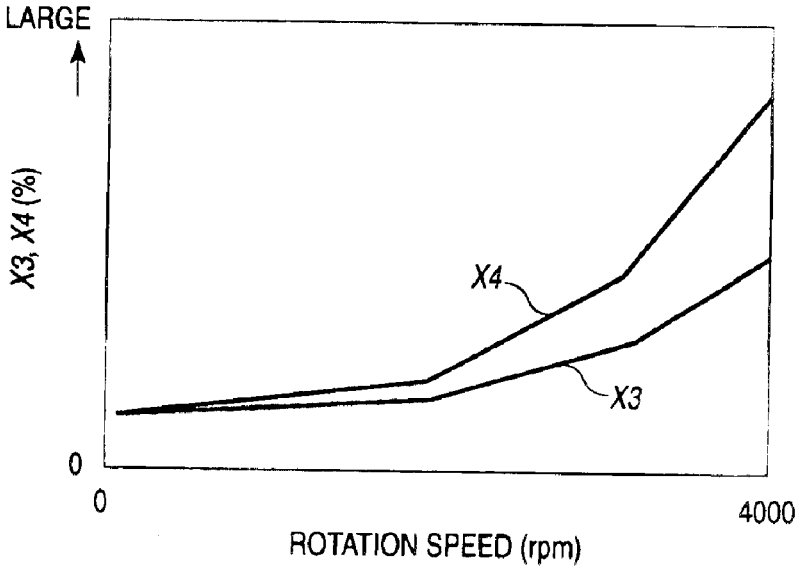
FIG. 15 is a diagram describing the characteristics of a map of a direct adhesion ratio of fuel to the combustion chamber wall surface and cylinder wall surface stored by the engine controller.

Next, the fuel distribution ratio calculating unit 52 calculates the distribution ratios X3 and X4 from the engine rotation speed Ne by looking up a map having the characteristics shown in FIG. 15. Referring to FIG. 6, the distribution ratios X3 and X4 are not much affected by the temperature of the gas around the fuel injector 21. Hence, the distribution ratios X3 and X4 may be determined only depending on the engine rotation speed Ne. This map is stored beforehand in the memory (ROM) of the controller 31.

The fuel distribution ratio calculating unit 52 calculates the distribution ratios X1 and X2 by the following equations (16) and (17) using the distribution ratios X0, X3 and X4 found by the above method.

$$X1=\{100-(X0+X3+X4)\}\cdot BT\# \quad (16)$$

$$X2=\{100-(X0+X3+X4)\}\cdot(1-BT\#) \quad (17)$$

where, BT#=intake valve direct adhesion rate.

Distribution Ratios Yn of the Fuel Adhering to the Part 15*a* of the Intake Valve 15

Y0: The fuel ratio of the fuel adhering to the part 15*a* which flows into the combustion chamber 5 as a gas or mist of fine particles, and burnt. The parameters affecting the distribution ratio Y0 are fuel volatility, intake valve temperature, gas temperature around the fuel injector 21, gas flow rate near the adhesion surface, intake negative pressure and the shape of a valve edge. The gas flow rate near the adhesion surface is affected by the diameter of the intake valve 15, engine rotation speed, opening of the swirl control valve in an engine provided with a swirl control valve, opening/closing timing of the intake valve 15 and valve lift of the intake valve 15.

The distribution ratio Y0 corresponds to the ratio of the seventh vaporized fuel amount in the claims.

Y1: The fuel ratio of the fuel adhering to the part 15*a* which adheres to the high temperature wall surface of the combustion chamber 5. The distribution ratio Y1 may be further divided into a fuel ratio Y1A which moves as droplets or a coarse particle mist from the part 15*a* to the combustion chamber 5 and adheres to the high temperature wall surface, and a fuel ratio Y1B which moves as wall flow from the part 15*a* via the valve body of the intake valve 15 to the part 15*b* facing the combustion chamber 5 or another high temperature wall surface in the combustion chamber 5.

The parameters affecting the ratio Y1A include the gas flow rate near the adhesion surface, temperature of the part 15*a,* temperature of the gas around the fuel injector 21 or the viscosity of the fuel, intake negative pressure, shape of the valve edge of the intake valve 15, and inflow direction of fuel and intake air into the combustion chamber 5.

The parameters affecting the ratio Y1B, in addition to the aforesaid parameters which affect Y1A, include the flow of the fuel-air mixture inside the combustion chamber 5.

The distribution ratio Y1 corresponds to the ratio of the sixth wall flow amount in the claims.

Y2: The fuel ratio of the fuel adhering to the part 15*a* which adheres to the low temperature wall surface of the combustion chamber 5. The distribution ratio Y2 may be further divided into a fuel ratio Y2A which moves as droplets or a coarse particle mist from the part 15*a* to the combustion chamber 5 and adheres to the low temperature wall surface, and a fuel ratio Y2B which moves as wall flow from the part 15*a* to the low temperature wall surface via the high temperature wall surface in the combustion chamber 5. The parameters affecting the distribution ratio Y2A include the gas flow rate, temperature of the part 15*a,* gas temperature around the fuel injector 21 or the fuel viscosity, intake negative pressure, shape of the valve seat end part and inflow direction of gas into the combustion chamber 5. The parameters affecting the distribution ratio Y2B, in addition to the aforesaid parameters affecting Y2A, include the gas flow inside the combustion chamber 5.

The distribution ratio Y2 corresponds to the ratio of the fifth wall flow amount in the claims.

Some fuel remains adhering to the part 15*a* up to the following combustion cycle. This is expressed by 1−Y0−Y1−Y2.

Distribution Ratios Zn of Fuel Adhering to the Wall Surface 4*a* of the Intake Port 4

Z0: The fuel ratio of the fuel adhering to the wall surface 4*a* which becomes a gas or mist of fine particles, flows into the combustion chamber 5, and is burnt. The parameters affecting Z0 are fuel volatility, temperature of the port wall surface 4*a,* gas temperature around the fuel injector 21, gas flow rate near the adhesion surface, intake negative pressure and shape of the valve end.

The flow rate of gas near the adhesion surface is affected by the diameter of the intake valve 15, engine rotation speed, opening of the swirl control valve in an engine provided with a swirl control valve, opening/closing timing of the intake valve 15 and valve lift of the intake valve 15. The distribution ratio Z0 corresponds to the ratio of the sixth vaporized fuel amount in the claims.

Z1: The fuel ratio of the fuel adhering to the wall surface 4*a,* which adheres to the high temperature wall surface of the combustion chamber 5. The distribution ratio Z1 may be further divided into a fuel ratio Z1A which moves as droplets or a coarse particle mist from the wall surface 4*a* to the combustion chamber 5 and adheres to the high temperature wall surface, and a fuel ratio Z1B which moves as wall flow from the wall surface 4*a* to the high temperature wall surface of the combustion chamber 5, such as the cylinder head surface 51.

The parameters affecting the distribution ratio Z1A include the gas flow rate near the adhesion surface, temperature of the wall surface 4*a,* gas temperature around the fuel injector or fuel viscosity, intake negative pressure, and inflow direction of gas into the combustion chamber 5. The parameters affecting the distribution ratio Z1B, in addition to the aforesaid parameters affecting the distribution ratio Z1A, include the gas flow inside the combustion chamber 5.

The distribution ratio Z1 corresponds to the ratio of the fourth wall flow amount in the claims.

Z2: The fuel ratio of the fuel adhering to the wall surface 4*a,* which adheres to the low temperature wall surface of the combustion chamber 5. The distribution ratio Z2 is further divided into a fuel ratio Z2A which moves as droplets or a coarse particle mist from the wall surface 4*a* to the combustion chamber 5 and adheres to the low temperature wall surface, and a fuel ratio Z2B which moves as wall flow from the wall surface 4*a* to the low temperature wall surface of the combustion chamber.

The parameters affecting the distribution ratio Z2A include the gas flow rate near the adhesion surface, temperature of the part 15*a* of the intake valve 15, gas temperature around the fuel injector or the fuel viscosity, intake negative pressure, shape of the valve edge of the intake valve 15, and the inflow direction of gas into the combustion chamber 5. The parameters affecting the distribution ratio Z2B, in addition to the aforesaid parameters affecting the distribution ratio Z2A, include the gas flow inside the combustion chamber 5.

The distribution ratio Z2 corresponds to the ratio of the third wall flow amount in the claims.

Some fuel remains adhering to the wall surface 4*a* until the following combustion cycle. This is expressed by 1−Z0−Z1−Z2.

Figure 9:
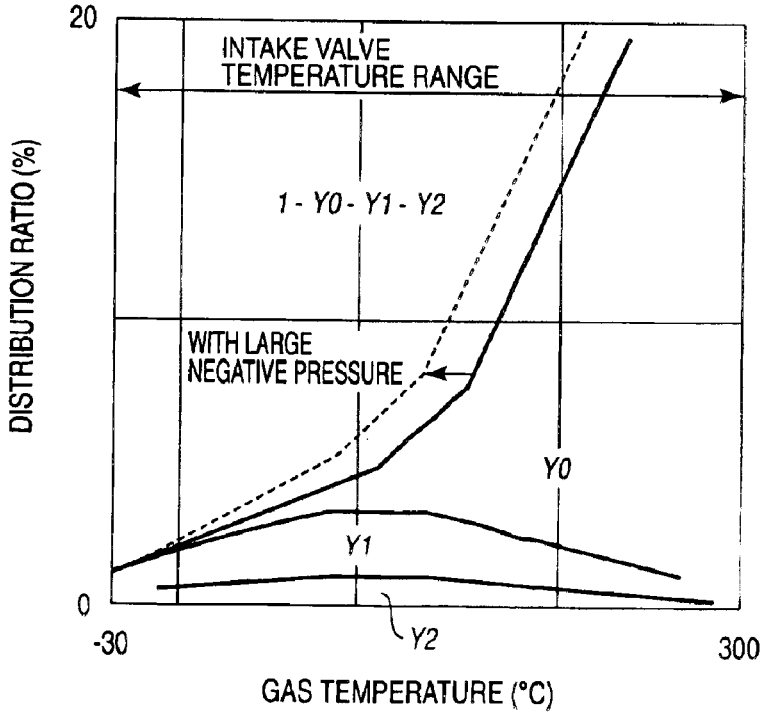
FIG. 9 is a diagram showing the distribution ratio characteristics of an intake valve wall flow experimentally verified by the Inventors.
Figure 10:
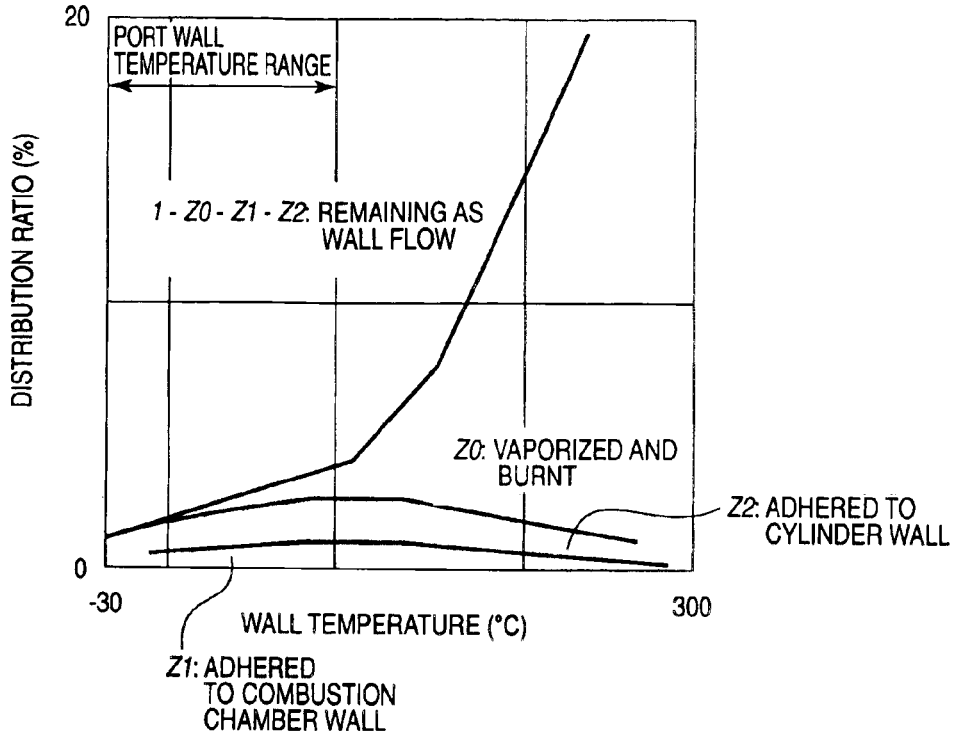
FIG. 10 is a diagram showing the distribution ratio characteristics of a port wall flow experimentally verified by the Inventors.

FIG. 9 shows the characteristics of the distribution ratios Yn of the fuel adhering to the part 15*a* of the intake valve 15 based on the above analysis. FIG. 10 shows the characteristics of the distribution ratios Zn of the fuel adhering to the wall surface 4*a* of the intake port 4 based on the above analysis. In FIGS. 9 and 10, the widths in the vertical direction of each region express the distribution ratios Yn and Zn. The division ratio (%) on the vertical axis expresses the percentage relative to the whole injection amount.

Referring to FIG. 9, when the temperature of the intake valve 15 rises, the vaporization ratio Y0 of the fuel adhering to the part 15*a* will increase. When the intake negative pressure increases, the region of the vaporization ratio Y0 further increases, as shown by the dotted line in the figure The temperature range which the intake valve 15 experiences extends from a cooling water temperature of Tw to Tw+300 degrees Centigrade.

Referring to FIG. 10, when the temperature of the wall surface 4*a* of the intake port 4 rises, the vaporization ratio Z0 of the fuel adhering to the wall surface 4*a* increases. Although this characteristic is similar to the characteristic of the vaporization ratio Y0 of FIG. 9, as the wall surface 4*a* of the intake port 4 is cooled by the effect of the cooling water of the engine water jacket, the temperature range experienced is limited to a temperature range from the cooling water temperature Tw−15 degrees Centigrade to the cooling water temperature Tw.

Also, the distribution ratio characteristics between the combustion chamber low temperature wall surface and the combustion chamber high temperature wall surface differ from the characteristics of FIG. 9. As the port wall flow due to fuel adhering to the wall surface 4*a* has a larger surface area than the valve wall flow due to fuel adhering to the part 15*a* of the intake valve 15, and the migration length is long, the ratio of Z1 and Z2 is less than the ratio of Y1 and Y2.

Maps of the characteristics shown in FIGS. 9 and 10 are stored beforehand in the memory (ROM) of the controller 31. The fuel distribution ratio calculating unit 52 calculates the distribution ratios Yn by looking up the map corresponding to FIG. 9 from the temperature and intake negative pressure of the intake valve 15. Also, the distribution ratios Zn are calculated by looking up the map corresponding to FIG. 10 from the temperature and intake negative pressure of the wall surface 4*a* of the intake port 4.

The negative pressure detected by the pressure sensor 46 is applied to the intake negative pressure. It is also possible to apply a value representative of the engine load which is closely related to intake negative pressure, i.e., for example, the aforesaid basic fuel injection amount Tp. The cooling water temperature Tw detected by the water temperature sensor 45, or a value lower than the cooling water temperature Tw by 15 degrees Centigrade is applied to the temperature of the wall surface 4*a* of the intake port 4. The temperature of the intake valve 15 is calculated by a known method from the cooling water temperature Tw and the running conditions of the engine 1. This calculation method is disclosed by Tokkai Hei 3-124237 published by the Japan Patent Office in 1991.

Distribution Ratios Vn of the Fuel Adhering to the High Temperature Wall Surface of the Combustion Chamber 5

V0: The fuel ratio of the fuel adhering to the high temperature wall surface which changes to gas or a mist of fine particles, and burnt. The parameters affecting the distribution ratio V0 are fuel volatility, temperature of the part 15*b* of the intake valve 15, temperature of the part of the exhaust valve 16 facing the combustion chamber 5, temperature of the wall surface 5*a* of the cylinder head, temperature of the crown 6*a* of the piston 6, temperature rise of air-fuel mixture due to compression, and combustion and gas flow rate over adhesion surface.

The gas flow rate over the adhesion surface is affected by the diameter of the intake valve 15, engine rotation speed, opening of the swirl control valve in an engine provided with a swirl control valve, opening/closing timing of the intake valve 15, and valve lift of the intake valve 15.

The distribution ratio V0 corresponds to the ratio of the third vaporized fuel amount in the claims.

V1: The fuel ratio of the fuel adhering to the high temperature wall surface which is vaporized or becomes a mist of fine particles according to the combustion gas temperature or the gas flow rate in the combustion chamber 5 after the expansion stroke of the piston 6, i.e., after the flame is extinguished, and is discharged without being burnt.

The parameters affecting the distribution ratio V1 are the same as the parameters affecting the distribution ratio V0.

The distribution ratio V1 corresponds to the ratio of the fifth vaporized fuel amount in the claims.

Some fuel remains adhering to the high temperature wall surface up to the following combustion cycle. This is expressed by 1−V1−V2.

Distribution Ratios Wn of the Fuel Adhering to the Low Temperature Wall Surface of the Combustion Chamber 5

W0: The fuel ratio of the fuel adhering to the low temperature wall surface which is vaporized or becomes a mist of fine particles, and is burnt. The parameters affecting the distribution ratio W0 are the fuel volatility, temperature of the low temperature wall surface, temperature rise of the air-fuel mixture due to compression and combustion, gas flow rate over the adhesion surface, pressure variation of the combustion chamber 5, volatility of engine lubricating oil, and adhesion amount of engine oil to the low temperature wall surface.

The gas flow rate over the adhesion surface is affected by the diameter of the intake valve 15, engine rotation speed, opening of the swirl control valve in an engine provided with a swirl control valve, opening/closing timing of the intake valve 15, and the valve lift of the intake valve 15.

The distribution ratio W0 corresponds to the ratio of the second vaporized fuel amount in the claims.

W1: The fuel ratio of the fuel adhering to the low temperature wall surface which is vaporized or becomes a mist of fine particles according to the combustion gas temperature or the gas flow rate in the combustion chamber 5 after the expansion stroke of the piston 6, i.e., after the flame is extinguished, and is discharged without being burnt.

The parameters affecting the distribution ratio W1 are the same as the parameters affecting the distribution ratio W0.

The distribution ratio W1 corresponds to the ratio of the fourth vaporized fuel amount in the claims

W2: The fuel ratio adhering to the low temperature wall surface which is diluted by engine lubricating oil, and flows out to the crankcase. Of the fuel adhering to the low temperature wall surface, the fuel flowing out to the crankcase comprises the fuel in the oil scraped off by a piston ring of the piston 6, and fuel which leaked from a gap between the piston ring and cylinder wall surface 5*b*.

The parameters affecting the distribution ratio W2 are the engine rotation speed, temperature of the cylinder wall surface 5*b*, thickness of the oil film of engine oil, shape of the piston ring, tension of the piston ring, pressure variation in the cylinder 5, piston ring gap and piston ring fitting gap. The thickness of the oil film of engine lubricating oil is affected by the oil amount, temperature and viscosity of engine lubricating oil.

Further, some fuel remains adhering to the low temperature wall surface up to the following combustion cycle. This is expressed by 1−W0−W1−W2.

Figure 11:
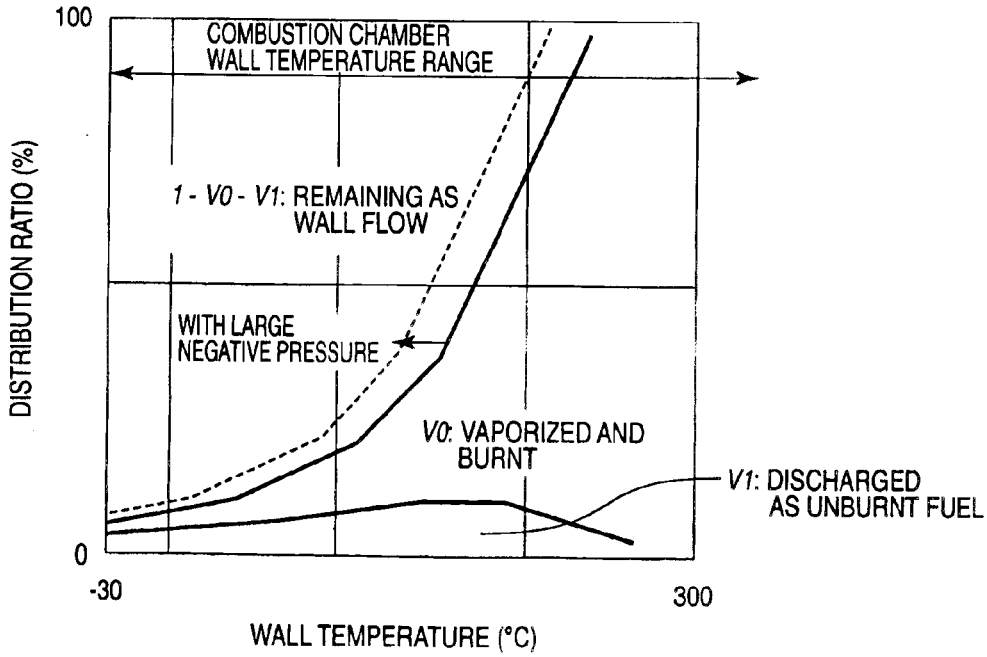
FIG. 11 is a diagram showing the distribution ratio characteristics of a combustion chamber wall flow experimentally verified by the Inventors.
Figure 12:
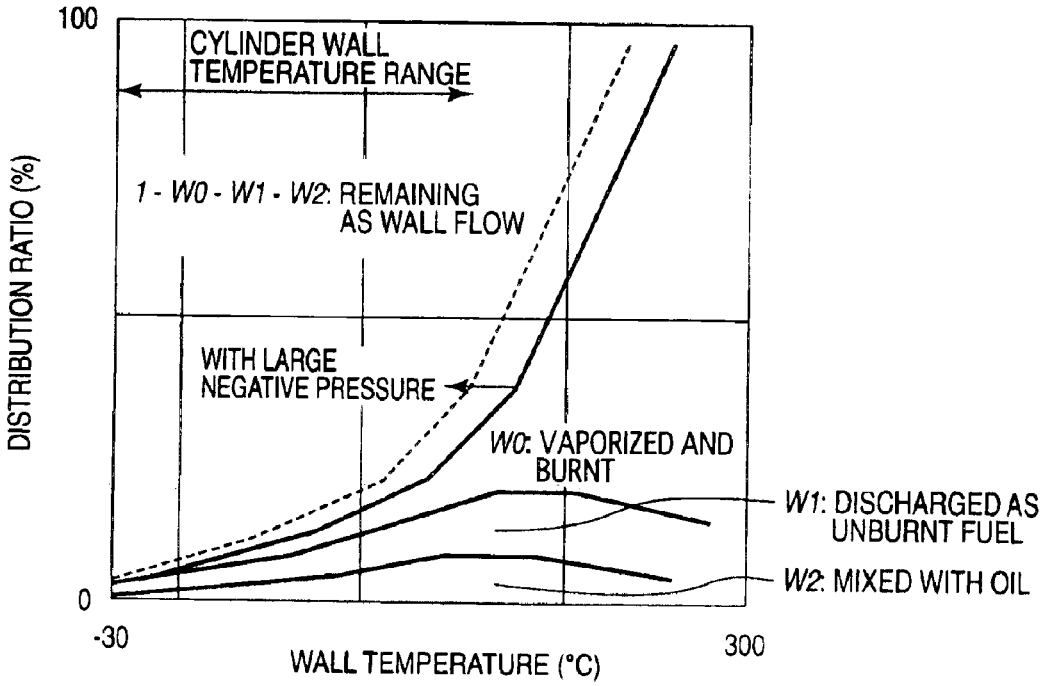
FIG. 12 is a diagram showing the distribution ratio characteristics of a cylinder surface wall flow experimentally verified by the Inventors.

FIG. 11 shows the characteristics of the distribution ratios Vn of the fuel adhering to the combustion chamber high temperature wall surface based on the above analysis. FIG. 12 shows the characteristics of the distribution ratios Wn of the fuel adhering to the combustion chamber low temperature wall surface based on the above analysis. The widths in the vertical direction of the regions of FIGS. 11 and 12 express the distribution ratios Vn and Wn.

The distribution ratio (%) on the vertical axis of FIG. 11 shows the percentage relative to the fuel adhesion amount of the combustion chamber high temperature wall surface. The distribution ratio (%) on the vertical axis of FIG. 12 shows the percentage relative to the fuel adhesion amount of the combustion chamber low temperature wall surface.

Referring to FIG. 11, the fuel vaporization ratio V0 increases as the temperature of the combustion chamber high temperature wall surface increases. If the intake negative pressure of the engine 1 increases as shown by the dotted line of the drawing, the vaporization ratio V0 will become larger, and the remaining fuel adhesion ratio will fall correspondingly. The temperature of the combustion chamber high temperature wall surface is affected by the temperature rise due to compression and combustion of the air-fuel mixture.

Referring to FIG. 12, the fuel vaporization ratio W0 increases as the temperature of the combustion chamber low temperature wall surface increases. If the intake negative pressure of the engine 1 increases as shown by the dotted line of the drawing, the vaporization ratio W0 will become larger, and the remaining fuel adhesion ratio will fall correspondingly. The temperature of the combustion chamber low temperature wall surface is affected by the temperature rise due to compression and combustion of the fuel-air mixture.

Maps of the characteristics shown in FIGS. 11 and 12 are stored beforehand in the memory (ROM) of the controller 31. The fuel distribution ratio calculating unit 52 calculates the distribution ratios Vn by looking up the map corresponding to FIG. 11 from the temperature of the combustion chamber high temperature wall surface and the intake negative pressure of the engine 1. The distribution ratios Wn are calculated by looking up the map corresponding to FIG. 12 from the temperature of the combustion chamber low temperature wall surface and the intake negative pressure of the engine 1.

The combustion chamber high temperature wall surface has a large temperature gradient across individual sites, but herein, the exhaust gas temperature detected by the exhaust gas temperature sensor 48 is used as a value expressing the temperature of the combustion chamber high temperature wall surface, as well as a value expressing the temperature of the intake valve 15.

The temperature of the combustion chamber low temperature wall surface is set to a value between Tw and Tw−15 degree Centigrade. Tw is the cooling water temperature of the engine 1 detected by the water temperature sensor 45.

As mentioned above, this invention individually analyzes the behavior of the fuel adhering to the combustion chamber high temperature wall surface, and the behavior of the fuel adhering to the combustion chamber low temperature wall surface, and performs calculation and control of the fuel injection amount using the individual behavior models obtained as a result.

Although the vaporization characteristics of adhering fuel largely differ on the combustion chamber low temperature wall surface of the cylinder wall surface 5*b*, and combustion chamber high temperature wall surfaces such as the cylinder head wall surface 5*a* and the part 15*b* of the intake valve 15 facing the combustion chamber 5, the behavior of the injected fuel can be correctly grasped by using the separate behavior models according to this invention, and in particular, the precision of air-fuel ratio control of the internal combustion engine in the transient state can be increased.

Next, referring to FIGS. 16–18, a second embodiment of this invention relating to the function of the demand determining unit 71 and the required injection amount calculating unit 75, will be described.

In the first embodiment, the required injection amount calculating unit 75 selectively applies equation (10) or (11) to the calculation of the required injection amount Fin based on the demand determined by the demand determining unit 71.

As a result, if the determination result of the demand determining unit 71 changes over, the required injection amount Fin will change stepwise, the engine output will change as a result, and a torque shock may occur.

In this embodiment, in order to prevent the torque shock accompanying change of demand, the demand determining unit 71 calculates a demand ratio according to the state of each demand.

The required injection amount calculating unit 75 calculates the required injection amount Fin by performing an interpolation calculation between the calculated value of equation (10), and the calculated value of equation (11).

The construction apart from the demand determining unit 71 and required injection amount calculating unit 75 is identical to that of the first embodiment. The state of each demand is determined as follows.

Figure 16:
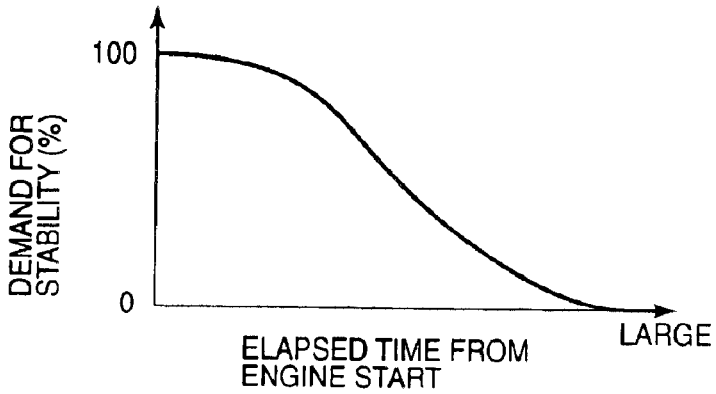
FIG. 16 is a diagram describing the characteristics of a map of stability demand of the engine stored by the engine controller according to a second embodiment of this invention.

Referring to FIG. 16, this embodiment considers that when the elapsed time after engine startup is zero, the demand for engine running stability is 100%, and the demand for engine running stability decreases with elapsed time.

Figure 17:
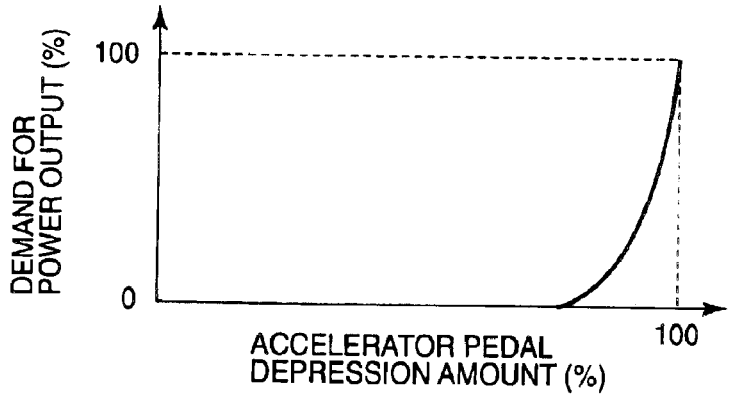
FIG. 17 is a diagram describing the characteristics of a map of power output demand of the engine stored by the engine controller according to the second embodiment of this invention.

Referring to FIG. 17, this embodiment considers that until the accelerator pedal depression amount exceeds a predetermined amount, the demand for engine output power is zero, and that the demand for engine output increases from 0 to 100% as the accelerator pedal depression amount increases from the predetermined amount to a maximum value.

Figure 18:
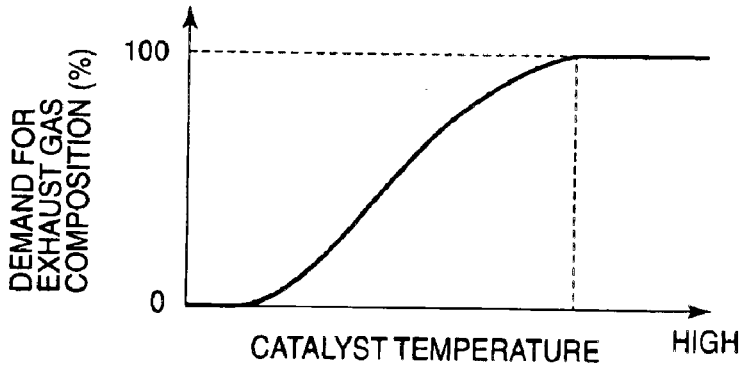
FIG. 18 is a diagram describing the characteristics of a map of exhaust gas composition demand of the engine stored by the engine controller according to second embodiment of this invention.

Referring to FIG. 18, this embodiment considers that when the catalyst temperature of the three-way catalytic converter 9 is equal to or more than the activation temperature, the demand for exhaust gas composition is 100%, the demand for exhaust gas composition immediately after engine startup is zero, and the demand increases towards 100% as the catalyst temperature rises.

Maps of demands having the characteristics shown in FIGS. 16–18 are stored beforehand in the memory (ROM) of the controller 31.

The demand determining unit 71 determines the demand for engine running stability by looking up a map corresponding to FIG. 16 from the elapsed time from startup of the engine 1. The demand determining unit 71 determines the demand for engine output power by looking up a map corresponding to FIG. 17 from the accelerator pedal depression amount detected by the accelerator pedal depression sensor 42. The demand determining unit 71 determines the demand for exhaust gas composition by looking up a map corresponding to FIG. 18 from the temperature detected by the catalyst temperature sensor 43.

The required injection amount calculating unit 75 selects the demand with the highest value from the three kinds of demand calculated by the demand determining unit 71. On the other hand, the calculations of equation (10) and equation (11) are performed, and the calculation result Fin1 of a equation (10) and the calculation result Fin2 of equation (11) are obtained. The required injection amount calculating unit 75 calculates the required injection amount Fin by performing an interpolation calculation by the following equation (18) from these calculation results and demands:

$$Fin = Fin2 \cdot (\text{demand}/100) + Fin1 \cdot (\text{demand}/100) \quad (18)$$

By applying an interpolation calculation according to the demand, to the calculation of the required injection amount Fin, a sharp change in the fuel injection amount when there is a change-over of demand does not occur, and torque shock can be prevented.

The contents of Tokugan 2003-064747, 2003-064760 and 2003-064766, with a filing date of Mar. 11, 2003 in Japan, are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

For example, the above embodiments are targeted at the internal combustion engine 1 provided with a L-jetronic type fuel injection device, but this invention can be applied also to an internal combustion engine provided with a D-jetronic type fuel injection device.

The control of fuel injection amount according to this invention using the behavior model of fuel adhering to the combustion chamber low temperature wall surface and the behavior model of fuel adhering to the combustion chamber high temperature wall surface, can be applied also to a direct injection type internal combustion engine wherein fuel is directly injected into the combustion chamber 5.

The embodiments of this invention in which an exclusive property or privilege is claimed are defined as follows:

What is claimed is:

1. A fuel supply control device for an internal combustion engine which comprises a combustion chamber formed from a low temperature wall surface and a high temperature wall surface, and a fuel supply mechanism which supplies volatile liquid fuel to the combustion chamber, the device comprising:

a sensor which detects a temperature of the low temperature wall surface;

a sensor which detects a temperature of the high temperature wall surface; and a programmable controller programmed to:

calculate respectively a fuel amount adhering to the low temperature wall surface, a fuel amount adhering to the high temperature wall surface, and a first vaporized fuel amount that is supplied in the form of gas or mist of fine particles in the combustion chamber relative to a fuel amount supplied by the fuel supply mechanism;

calculate a second vaporized fuel amount which vaporizes from the fuel adhering to the low temperature wall surface and burns, according to the temperature of the low temperature wall surface;

calculate a third vaporized fuel amount which vaporizes from the fuel adhering to the high temperature wall surface and burns, according to the temperature of the high temperature wall surface;

calculate a combustion fuel amount in the combustion chamber based on the first vaporized fuel amount, the second vaporized fuel amount, and the third vaporized fuel amount;

calculate a target fuel injection amount based on the combustion fuel amount; and control a fuel amount to be supplied by the fuel supply mechanism according to the target fuel injection amount.

2. The fuel injection control device as defined in claim 1, wherein the controller is further programmed to increase the second vaporized fuel amount relative to the fuel amount supplied by the fuel supply mechanism as the temperature of the low temperature wall surface rises, and to increase the third vaporized fuel amount relative to the fuel amount supplied by the fuel supply mechanism as the temperature of the high temperature wall surface rises.

3. The fuel injection control device as defined in claim 1, wherein the engine further comprises a piston which expands and contracts the combustion chamber, and an intake passage which aspirates air into the combustion chamber according to an expansion of the combustion chamber, the device further comprises a sensor which detects an intake negative pressure of the engine, and the controller is further programmed to increase the second vaporized fuel amount and the third vaporized fuel amount relative to the fuel amount supplied by the fuel supply mechanism as the intake negative pressure increases.

4. The fuel injection control device as defined in claim 1, wherein the engine comprises a piston which expands and contracts the combustion chamber, a cylinder which houses the piston and is cooled by cooling water, and a cylinder head, the combustion chamber being formed by a wall surface of the cylinder, a crown of the piston and a wall surface of the cylinder head, the low temperature wall surface comprises the wall surface of the cylinder, and the high temperature wall surface comprises the crown of the piston and the wall surface of the cylinder head.

5. The fuel injection control device as defined in claim 4, wherein the engine further comprises an intake passage, an intake port formed in the cylinder head which connects the intake passage and combustion chamber, and an intake valve which opens and closes the intake port, and the fuel supply mechanism comprises a fuel injector which injects fuel towards the intake valve in the intake port.

6. The fuel injection control device as defined in claim 5, wherein the device further comprises a sensor which detects a temperature of a gas which circulates through the intake port, and the controller is further programmed to increase the first vaporized fuel amount relative to the fuel amount supplied by the fuel supply mechanism.

7. The fuel injection control device as defined in claim 1, wherein the engine further comprises an exhaust passage, an exhaust valve which discharges exhaust gas from the combustion chamber to the exhaust passage, and a three-way catalytic converter which purifies the exhaust gas in the exhaust passage, the device further comprises a sensor which detects a catalyst temperature of the three-way catalytic converter, and the controller is further programmed to calculate a fourth vaporized fuel amount which is vaporized from the fuel adhering to the low temperature wall surface and discharged to the exhaust passage without burning according to the temperature of the low temperature wall surface, calculate a fifth vaporized fuel amount which is vaporized from the fuel adhering to the high temperature wall surface and discharged to the exhaust passage without burning according to the temperature of the high temperature wall surface, and determine the target fuel injection amount after the catalyst temperature has reached an activation temperature based on a total amount of the combustion fuel amount in the combustion chamber, the fourth vaporized fuel amount and the fifth vaporized fuel amount to cause an exhaust gas composition in the exhaust passage to correspond with a stoichiometric air-fuel ratio.

8. The fuel injection control device as defined in claim 7, wherein the engine comprises an engine for driving a vehicle provided with an accelerator pedal, the device comprises a sensor which detects an accelerator pedal depression amount, and the controller is further programmed to, when the accelerator pedal depression amount exceeds a predetermined amount, determine the target fuel injection amount based on the combustion fuel amount to cause the engine to operate under a predetermined rich air-fuel ratio.

9. The fuel injection control device as defined in claim 7, wherein the controller is further programmed to measure an elapsed time from startup of the engine, and until the elapsed time reaches a predetermined engine warm-up time, determine the target fuel injection amount based on the combustion fuel amount to cause the engine to operate under a predetermined rich air-fuel ratio.

10. The fuel injection control device as defined in claim 1, wherein the engine comprises an intake passage, a cylinder head, an intake port formed in the cylinder head which connects the intake passage and the combustion chamber, and an intake valve which opens and closes the intake port, the fuel supply mechanism comprises a fuel injector which injects fuel towards the intake valve in the intake port, the controller is further programmed to respectively calculate a fuel amount adhering to the wall surface of the intake port, a fuel amount adhering to the intake valve, a first wall flow amount adhering directly to the low temperature wall surface, and a second wall flow amount adhering directly to the high temperature wall surface, relative to the fuel amount supplied by the fuel supply mechanism, calculate a third wall flow amount which has moved from the wall surface of the intake port and adhered to the low temperature wall surface and a fourth wall flow amount which has moved from the wall surface of the intake port and adhered to the high temperature wall surface, calculate a fifth wall flow amount which has moved from the intake valve and adhered to the low temperature wall surface and a sixth wall flow amount which has moved from the intake valve and adhered to the high temperature wall surface, calculate the fuel amount adhering to the low temperature wall surface based on the first wall flow amount, third wall flow amount and fifth wall flow amount, and calculate the fuel amount adhering to the high temperature wall surface based on the second wall flow amount, fourth wall flow amount and sixth wall flow amount.

11. The fuel injection control device as defined in claim 10, wherein the controller is further programmed to calculate a sixth vaporized fuel amount flowing into the combustion chamber which is a part of the fuel amount adhering to the wall surface of the intake port, and a seventh vaporized fuel amount flowing into the combustion chamber which is a part the fuel adhering to the intake valve, and calculate the combustion fuel amount based on the first vaporized fuel amount, the sixth vaporized fuel amount, and the seventh vaporized fuel amount.

12. The fuel injection control device as defined in claim 11, wherein the device further comprises a sensor which detects a cooling water temperature of the engine, and the controller is further programmed to increase the first vaporized fuel amount as the cooling water temperature increases.

13. The fuel injection control device as defined in claim 12, wherein the device further comprises a sensor which detects a temperature of the intake valve, and the controller is further programmed to calculate the temperature of the wall surface of the intake port from the cooling water temperature, increase the sixth vaporized fuel amount relative to the fuel amount adhering to the wall surface of the intake port as the temperature of the wall surface of the intake port rises, and increase the seventh vaporized fuel amount relative to the fuel adhering to the intake valve as the temperature of the intake valve rises.

14. The fuel injection control device as defined in claim 11, wherein the device further comprises a sensor which detects an intake negative pressure of the engine, and the controller is further programmed to increase the first vaporized fuel amount as the intake negative pressure increases.

15. The fuel injection control device as defined in claim 11, wherein the device further comprises a sensor which detects an intake negative pressure of the engine, and the controller is further programmed to increase the seventh vaporized fuel amount relative to the fuel adhering to the intake valve as the intake negative pressure increases.

16. The fuel injection control device as defined in claim 11, wherein the controller is further programmed to calculate the first vaporized fuel amount, the fuel amount adhering to the wall surface of the intake port, the fuel amount adhering to the intake valve, the first wall flow amount, and the second wall flow amount relative to the fuel amount supplied by the fuel supply mechanism, according to a fuel injection timing of the fuel injector.

17. A fuel supply control device for an internal combustion engine which comprises a combustion chamber formed from a low temperature wall surface and a high temperature wall surface, and a fuel supply mechanism which supplies volatile liquid fuel to the combustion chamber, the device comprising:

means for detecting a temperature of the low temperature wall surface;

means for detecting a temperature of the high temperature wall surface;

means for calculating respectively a fuel amount adhering to the low temperature wall surface, a fuel amount adhering to the high temperature wall surface, and a first vaporized fuel amount that is supplied in the form of gas or mist of fine particles in the combustion chamber relative to a fuel amount supplied by the fuel supply mechanism;

means for calculating a second vaporized fuel amount which vaporizes from the fuel adhering to the low temperature wall surface and burns, according to the temperature of the low temperature wall surface;

means for calculating a third vaporized fuel amount which vaporizes from the fuel adhering to the high temperature wall surface and burns, according to the temperature of the high temperature wall surface;

means for calculating a combustion fuel amount in the combustion chamber based on the first vaporized fuel amount, the second vaporized fuel amount, and the third vaporized fuel amount;

means for calculating a target fuel injection amount based on the combustion fuel amount; and means for controlling a fuel amount to be supplied by the fuel supply mechanism according to the target fuel injection amount.

18. A fuel supply control method for an internal combustion engine which comprises a combustion chamber formed from a low temperature wall surface and a high temperature wall surface, and a fuel supply mechanism which supplies volatile liquid fuel to the combustion chamber, the method comprising:

determining a temperature of the low temperature wall surface;

determining a temperature of the high temperature wall surface;

calculating respectively a fuel amount adhering to the low temperature wall surface, a fuel amount adhering to the high temperature wall surface, and a first vaporized fuel amount that is supplied in the form of gas or mist of fine particles in the combustion chamber relative to a fuel amount supplied by the fuel supply mechanism;

calculating a second vaporized fuel amount which vaporizes from the fuel adhering to the low temperature wall surface and burns, according to the temperature of the low temperature wall surface;

calculating a third vaporized fuel amount which vaporizes from the fuel adhering to the high temperature wall surface and burns, according to the temperature of the high temperature wall surface;

calculating a combustion fuel amount in the combustion chamber based on the first vaporized fuel amount, the second vaporized fuel amount, and the third vaporized fuel amount;

calculating a target fuel injection amount based on the combustion fuel amount; and controlling a fuel amount to be supplied by the fuel supply mechanism according to the target fuel injection amount.

* * * * *